US006302937B1

(12) United States Patent
Hayashi et al.

(10) Patent No.: US 6,302,937 B1
(45) Date of Patent: Oct. 16, 2001

(54) SINTERED ALLOY HAVING SUPERIOR WEAR RESISTANCE

(75) Inventors: Koichiro Hayashi; Yoshimasa Aoki, both of Kashiwa; Koichi Aonuma, Matsudo, all of (JP)

(73) Assignee: Hitachi Powdered Metals, Co., Ltd., Chiba (JP)

( * ) Notice: Subject to any disclaimer, the term of this patent is extended or adjusted under 35 U.S.C. 154(b) by 0 days.

(21) Appl. No.: 09/450,204

(22) Filed: Nov. 29, 1999

(51) Int. Cl.[7] ..... C22C 33/00
(52) U.S. Cl. ..... 75/231; 75/240; 75/246
(58) Field of Search ..... 75/240, 243, 246, 75/231

(56) References Cited

U.S. PATENT DOCUMENTS

| | | | |
|---|---|---|---|
| 3,812,565 | 5/1974 | Seino et al. . | |
| 4,919,719 | 4/1990 | Abe et al. | 75/243 |
| 5,824,644 | 11/1998 | Aonuma et al. | 75/246 |
| 5,824,922 | 10/1998 | Aonuma et al. | 75/236 |
| 5,859,376 * | 1/1999 | Ishibashi et al. | 75/243 |
| 5,952,590 | 9/1999 | Kawata et al. | 75/231 |

FOREIGN PATENT DOCUMENTS

| | | |
|---|---|---|
| 17968/74 | 2/1974 | (JP) . |
| 55-73852 A | 6/1980 | (JP) . |
| 62-10244 A | 1/1987 | (JP) . |
| 1-152247 A | 6/1989 | (JP) . |
| 09195014 | 7/1997 | (JP) . |

* cited by examiner

*Primary Examiner*—Ngoclan Mai
(74) *Attorney, Agent, or Firm*—Scully, Scott, Murphy & Presser

(57) ABSTRACT

The present invention provides a sintered material having high mechanical strength and superior wear resistance, and to a process of manufacture therefor. A sintered alloy having superior wear resistance has an overall composition consisting of, in percent by weight, Ni in an amount of 6.0 to 25.0%, Cr in an amount of 0.6 to 8.75%, C in an amount of 0.54 to 2.24%, and balance consisting of Fe, the sintered alloy exhibiting a metallographic structure in which the following hard phase is dispersed in a mixed structure of martensite and austenite, the hard phase comprising a core consisting of Cr carbide and a ferrite phase diffused Cr, or a mixed phase of ferrite and austenite diffused Cr, surrounding the core, and an area ratio of austenite in the mixed structure in the metallographic structure ranging from 5 to 30%.

16 Claims, 18 Drawing Sheets

SINTERED ALLOY HAVING SUPERIOR WEAR RESISTANCE

BACKGROUND OF THE INVENTION

The present invention relates to a sintered alloy which exhibits superior wear resistance and to a process of manufacture therefor, and more particularly, relates to a technique suitable for use for valve seats in internal combustion engines.

Recently, with the increasing performance of automobile engines, operating conditions have become much more severe. The valve seats used for such engines are also inevitably required to withstand more severe environments than before. To meet such requirements, the present applicant previously proposed several sintered alloys having superior wear resistance as disclosed in, for example, Japanese Examined Patent Publications (KOKOKU) Nos. 17968/74, 36242/80, 56547/82, 55593/93, and 98985/95.

Of all the proposed sintered alloys having superior wear resistance, the sintered alloy disclosed in Japanese Examined Patent Publication (KOKOKU) No. 55593/9395 is particularly improved in wear resistance. The sintering alloy exhibits a metallographic structure in which diffusing phase diffused Co is surrounded by a hard phase consisting of Mo silicide in a matrix structure, and superior wear resistance is obtained by the presence of the hard phase. A matrix is disclosed in Japanese Examined Patent Publication (KOKOKU) No. 36242/80. A sintered alloy having superior wear resistance disclosed in Japanese Examined Patent Publication (KOKOKU) No. 98985/95 is an improvement of the alloy disclosed in Japanese Patent Examined Publication (KOKOKU) No. 55593/93. By including Ni in an amount of 5 to 27% by weight in the alloy of Publication (KOKOKU) No. 55593/93, the matrix structure is strengthened, thereby further improving wear resistance.

However, since these alloys use expensive materials such as Co, they may not meet the demands for recent cost-performance. That is to say, the development of automobiles is recently directed not only to higher performance but also to lower cost from an economic point of view. Therefore, the present applicant proposed a sintered alloy having superior wear resistance which can yield the required wear resistance using inexpensive materials in Japanese Examined Patent Publication (KOKOKU) No. 195012/97. In this proposal, by using a powder which partially diffuses each powder of Ni, Cu, and Mo into Fe powder, as a matrix forming powder, the matrix is strengthened, and by dispersing the hard phase primarily consisting of Cr carbide into this matrix structure, the required wear resistance and mechanical strength are obtained without using expensive materials such as Co.

However, the demands on cost-performance become more severe every year, and a sintered alloy having superior wear resistance for the valve seat, which is less expensive than the above-proposed sintered alloy having superior wear resistance, is further demanded. Therefore, since expensive materials such as Mo are used in the above-proposed sintered alloy having superior wear resistance, it seems that there is room for further improvement concerning the use of materials.

At present, the conditions for operation are even further increased in severity as the performance of automobile engines continues to improve, and a material, which is superior in wear resistance and in strength to the above-mentioned sintered alloys, is demanded.

SUMMARY OF INVENTION

The present invention has been made in view of the above situation. It is therefore an object of the present invention to provide a sintered material which can further improve mechanical strength and wear resistance without using expensive materials, and to provide a process of manufacture therefor.

The first sintered alloy having superior wear resistance according to the present invention relates to an improvement of a sintered alloy having superior wear resistance which was previously disclosed in Japanese Unexamined Patent Application Publication No. 195012/97 by the present applicant. In this sintered alloy, Mo is removed from components forming a matrix structure and the Ni content therein is increased, whereby austenite is adjusted to a suitable ratio, so that an object of the present invention is attained.

Therefore, the first sintered alloy having superior wear resistance according to the present invention has an overall composition consisting of, in percent by weight, Ni in an amount of 6.0 to 25.0%, Cr in an amount of 0.6 to 8.75%, C in an amount of 0.54 to 2.24%, and the balance consisting of Fe and inevitable impurity, the sintered alloy exhibiting a metallographic structure in which a hard phase is dispersed in a mixed structure of martensite and austenite, the hard phase comprising a core consisting of Cr carbide and a ferrite phase diffused Cr or a mixed phase of ferrite and austenite diffused Cr surrounding the core, and the area ratio of austenite in the mixed structure in the metallographic structure ranges from 5 to 30%.

Effects of the sintered alloy having superior wear resistance thus formed, as well as the basis for the numerical limitations, will now be described with reference to FIG. 1.

① Matrix

FIG. 1 is a schematic view showing a metallographic structure of the sintered alloy having superior wear resistance, whose surface is subjected to corrosion treatment by nital or the like. As shown in FIG. 1, the matrix for this sintered alloy has a mixed structure of martensite and austenite. The martensite has high hardness and high mechanical strength, so that it is capable of contributing to the improvement of wear resistance. However, because of the hardness, the wear on a valve as counterpart component element is made worse. Grains worn from the counterpart component element function as abrasive grains, and the wear on the valve seat is consequentially increased. Therefore, by dispersing austenite having a high toughness, the counterpart component element is less damaged, without decreasing the wear resistance of the matrix. According to research by the inventors, when the area ratio of austenite is less than 5%, the martensite content is too high, whereby abrasion of the counterpart component element is increased, while when the area ratio of austenite is more than 30%, the wear resistance and the mechanical strength are decreased.

Although not shown in FIG. 1, sorbite or bainite is often formed, depending on the component constituent and the cooling conditions after sintering. In the present invention, such a formation is also included. For example, such a formation is a structure in which bainite surrounds a core consisting of sorbite and/or the bainite. A mixed structure includes bainite having high hardness and high strength in proximity to martensite, whereby adjustment to suitable hardness can maintain the wear resistance and can suppress the abrasion of the counterpart component element. Whether to produce the martensite or the bainite may be decided by the below-described dispersing concentration of elements which improve the hardenability of Ni, Cr, or the like, and the cooling rate thereof. That is, in a portion in which such element is enriched (high concentration), the structure thereof transforms into martensite, and then in a portion in which such element is enriched, the structure thereof is transformed into bainite. When the cooling is rapid, the structure thereof is transformed into martensite, and then when the cooling continues rapidly, the structure thereof is transformed into bainite. In contrast, in portions in which the above-described elements which improve hardenability are scarce, or in the case in which cooling rate is low, the structure is transformed into sorbite and/or the bainite.

② Hard Phase

As shown in FIG. 1, a hard phase, in which ferrite phase or mixed phase of ferrite and austenite surrouds a core consisting of Cr carbide, is dispersed in the matrix. The core of Cr carbide has higher hardness than martensite, whereby wear resistance is further improved. The ferrite phase or the mixed phase of ferrite and austenite has high toughness because the Cr content is high, and is bound to the core of Cr carbide in the matrix. The above phase employs as a buffer material which absorbs shocks to the core when a valve is seated, and it prevents the escape of the carbide. Moreover, the matrix is strengthened by diffusing Cr of the hard phase into the matrix, whereby the wear resistance is further improved.

The basis for the numerical limitations of the above chemical composition is described hereinafter.

Ni: Ni is diffused into the matrix so as to be dissolved in the matrix to strengthen the matrix, thereby contributing to the improvement of wear resistance. It also serves to improve the hardenability of the structure of the matrix, thereby promoting martensite transformation. The portion where Ni is at high concentration remaines as soft austenite, thereby improving the toughness of the matrix. If the Ni content is less than 6.0% by weight, the above-mentioned effects are insufficiently obtained. In contrast, if it is more than 25.0% by weight, the amount of the soft austenite phase is increased, so that wear resistance is deteriorated. For this reason, the Ni content is limited to the range of 6.0 to 25.0% by weight.

Cr: Cr can dissolve (in a solid solution) in the matrix to strengthen the matrix and improve the hardenability of the structure of the matrix. Owing to this function, Cr contributes to both the mechanical strength and the wear resistance of the matrix. Cr forms the hard phase having a core consisting of Cr carbide, thereby further improving the wear resistance. Moreover, Cr diffused into the matrix from the hard phase has such functions as binding the hard phase firmly to the matrix, further strengthening the structure of the matrix, and further improving the hardenability. Furthermore, the portion around the hard phase where Cr is at high concentration forms a mixed phase of ferrite, or ferrite and austenite, so that effects may be obtained of absorbing shocks when a valve is seated and preventing the escape of hard components such as Cr carbide, etc., from the contact surfaces. If the Cr content is less than 0.6% by weight, the above-mentioned effects are insufficiently obtained. In contrast, if it is more than 8.75% by weight, the powder is hardened, deteriorating the compacting property. For this reason, the Cr content is limited to the range of 0.6 to 8.75% by weight.

C: C serves to strengthen the matrix and contributes to the improvement of the wear resistance. Also, C forms Cr carbide to further contribute to the improvement of the wear resistance. If the content of C is less than 0.54%, ferrite, which is low in both wear resistance and mechanical strength, remains in the structure of the matrix, and the carbide is insufficiently formed, thereby deteriorating the wear resistance. In contrast, if it is more than 2.24% by weight, cementite begins to precipitate at the grain boundaries, weakening the matrix and decreasing strength, and the amount of carbide formed is increased, promoting the wear of the counterpart component element. Moreover, the powder is hardened, deteriorating the compacting property. For this reason, the content of C is limited to the range of 0.54 to 2.24% by weight.

The second sintered alloy having superior wear resistance according to the present invention is characterized in that the core of the hard phase is formed of at least one of Mo carbide, V carbide, and W carbide as well as Cr carbide by adding at least one of Mo, V, and W to the above sintered alloy having superior wear resistance.

That is to say, the second sintered alloy having superior wear resistance according to the present invention has an overall composition consisting of, in percent by weight, Ni in an amount of 6.0 to 25.0%, Cr in an amount of 0.6 to 8.75%, C in an amount of 0.54 to 2.24%, at least one of Mo in an amount of 0.05 to 1.05%; V in an amount of 0.03 to 0.77%; and W in an amount of 0.15 to 1.75%, and the balance consisting of Fe; the sintered alloy exhibiting a metallographic structure in which a hard phase is dispersed in a mixed structure of martensite and austenite, the hard phase comprising a core consisting of Cr carbide as a main component, and a ferrite phase diffused Cr, or a mixed phase of ferrite and austenite diffused Cr, surrounding the core; and the area ratio of austenite in the mixed structure in the metallographic structure ranges from 5 to 30%.

In a sintered alloy having superior wear resistance thus constructed, the hard particles (core) in the hard phase consist of, in addition to Cr carbide, Mo carbide, V carbide, or W carbide, and an intermetallic compound of Cr and Mo, V, or W. That is, the sintered alloy has a metallographic structure in which the core consisting of Cr carbide in the schematic view of FIG. 1 is replaced by a core consisting of Cr carbide as a main component. V and W form fine carbide with C to contribute to an improvement in wear resistance, and the intermetallic compound and the carbide have the effect of preventing the Cr carbide from coarsening. Because coarsened Cr carbide promotes wear of the counterpart component element, the wear on the valve as a counterpart component element is reduced by such preventive means and the wear resistance is improved. Mo can dissolve (in a solid solution) into the matrix to strengthen the matrix and improve the hardenability of the structure of the matrix. Owing to such functions, it contributes to mechanical strength and the wear resistance of the matrix. V can also dissolve (in a solid solution) into the matrix to strengthen the matrix and to improve the wear resistance thereof. Therefore, the second sintered alloy having superior wear resistance according to the present invention has, as a matter of course, the above superior characteristics, and in addition, is further improved in wear resistance.

Here, if the contents of Mo, V, and W are less than 0.05% by weight, 0.03% by weight, and 1.05% by weight, respectively, the above-described effects cannot be expected. In contrast, if the contents are more than 1.05% by weight, 0.77% by weight, and 1.75% by weight, respectively, the powder is hardened, deteriorating the compacting property, and the amount of precipitated intermetallic compound and the carbide are increased, promoting the wear of the counterpart component element. For this reason, in the second sintered alloy having superior wear resistance, the Mo content is limited to the range of 0.05 to 1.05% by weight, the V content is limited to the range of 0.03 to 0.77% by weight, and the W content is limited to the range of 0.15 to 1.75% by weight. According to research by the inventors, it is confirmed that the above problems do not occur, even if these elements are used together, when the contents of Mo, V, and W are within the uppermost limits described above.

It is preferred that at least one of manganese sulfide, lead, and magnesium metasilicate mineral be dispersed in an amount of 0.1 to 2.0% by weight in the metallographic structure of the first and the second sintered alloy having superior wear resistance. These compounds improve machinability, and therefore, by dispersing in the matrix, they decrease the cutting force and serve as an initiating point for chip breaking when cutting is carried out, thereby enabling improvement of the machinability of the sintered alloy. If the contents of the machinability improving components are less that 0.1% by weight, the effects are insufficiently obtained. In contrast, if they are more than 2.0% by weight, the machinability improving components suppress diffusion of powders thereof during sintering, whereby the mechanical strength of the sintered alloy is deteriorated. For this reason, the contents of the above machinability improving components are limited to the range of 0.1 to 2.0% by weight.

It is preferred that pores formed in the above sintered alloy having superior wear resistance is filled with lead, copper, a copper alloy, or an acrylic resin. They are also machinability improving components. Particularly, when a sintered alloy having pores is cut, it is cut intermittently so that shocks are applied to the edge of the cutting tool. However, by having the pores filled with lead, copper, a copper alloy, or an acrylic resin such a sintered alloy can be cut in a continuous manner and shocks applied to the edge of the cutting tool are absorbed. The lead serves as a solid lubricant. Since the copper or copper alloy is high in thermal conductivity, it prevents heat from being internally confined, so that the edge of the cutting tool can be less damaged by heat. The acrylic resin serves as an initiating point of chip breaking in a cutting operation.

The process of manufacture for a sintered alloy having superior wear resistance according to the present invention is characterized by comprising preparing a mixed powder mixing a matrix forming powder and a hard phase forming powder, the matrix forming powder consisting of, in percent by total weight, graphite powder in an amount of 0.5 to 1.4%, Ni in an amount of 6.0 to 25.0%, and the balance of Fe; the hard phase forming powder consisting of, in percent by weight, Cr in an amount of 4.0 to 25.0%, C in an amount of 0.25 to 2.4%, and the balance of Fe; and the mixed powder is such that the hard phase forming powder in an amount of 15.0 to 35.0% is mixed with the matrix forming powder in an amount of 0.6 to 1.2%, compacting and sintering by using the mixed powder, forming a metallographic structure in which a hard phase is dispersed in a mixed structure of martensite and austenite, the hard phase comprising a core consisting of Cr carbide, and a ferrite phase diffused Cr, or a mixed phase of ferrite and austenite diffused Cr, surrounding the core, and the area ratio of austenite in the mixed structure in the metallographic structure ranges from 5 to 30%.

The components of each powder and the reasons for limiting the ratio thereof are described below.

(1) Matrix Forming Powder

Ni: Ni can dissolve (in a solid solution) in the matrix to strengthen the matrix, thereby contributing to improvement in wear resistance. It also serves to improve the hardenability of the structure of the matrix, thereby promoting martensite transformation. The portion where Ni is at high concentration remains as austenite, thereby improving the toughness of the matrix.

Ni can be added simply and easily in the form of a simple powder; however, considering fluidity, a powder which partially diffuses Ni into an Fe powder, or an alloy powder alloyed Ni (Fe—Ni alloy powder) can be used alone or in combination. However, if only the Fe—Ni alloy powder is added, concentration of Ni is uniform, whereby segregation of components does not occur. As a result, a mixed structure of martensite and austenite is not formed in the matrix. Therefore, addition of Ni is preferably according to the following five embodiments. Partial diffusion refers to a Ni powder being diffused into an Fe powder and fixed therein.

① Fe powder+Ni powder
② Partially Ni diffused Fe powder
③ Partially Ni diffused Fe powder+Ni powder
④ Fe—Ni alloy powder (pre-alloy)+Ni powder
⑤ Powder which partially diffuses Ni into Fe—Ni alloy powder In these embodiments, if Ni content in the total mixed powder is less than 6.0% by weight, such effects cannot be anticipated. In contrast, if Ni content in the total mixed powder is in excess of 25.0% by weight, the content of the remaining austenite is increased, whereby the wear resistance and the mechanical strength is deteriorated. Therefore, the Ni content in the matrix forming powder is limited to the amount corresponding to Ni in an amount of 6.0 to 25.0% by weight in the total mixed powder.

Graphite: When the C is applied, in its dissolved state, to the Fe powder or the Ni power, the alloy powder is hardened, deteriorating the compacting property. For this reason, it is applied in the form of graphite powder. C, which is applied in the form of graphite powder, strengthens the matrix and improves the wear resistance. If the amount of C added is less than 0.50% by weight, the ferrite, which deteriorates in both wear resistance and strength, remains in the structure of the matrix, and the precipitation amount of Cr carbide is insufficiently obtained. In contrast, if it is more than 1.40% by weight, cementite begins to precipitate at the grain boundary, weakening the matrix and decreasing the strength. For this reason, the graphite to be added is limited to the range of 0.50 to 1.40% by weight with respect to the weight of the mixed powder.

(2) Hard Phase Forming Powder

The hard phase forming powder is Fe—Cr—C alloy powder, and reasons for limiting the ratios of components thereof are described.

Cr: Cr contained in the hard phase forming powder forms Cr carbide with C contained in this alloy powder and serves as a core of the hard phase, thereby contributing to improvement in wear resistance. Part of the Cr is diffused into the matrix to improve the hardenablity of the matrix and to promote martensite transformation. In a portion around the hard phase where Cr is at high concentration, the part of Cr forms a ferrite phase, or mixed phase of ferrite and austenite, yielding the effect of absorbing shocks when a valve is seated. If the Cr content contained in the hard phase forming powder is less than 4% by weight with respect to the total weight of the hard phase forming powder, the amount of Cr carbide formed is insufficient and is thus unable to contribute to improvement in wear resistance. In contrast, if it is more than 25% by weight, the amount of carbide formed is increased, promoting wear of the counterpart component element, and the powder is hardened, deteriorating the compacting property. As the amount of the ferrite phase or the mixed phase of ferrite and austenite, is increased, wear resistance is also deteriorated. For this reason, the content of Cr contained in the hard phase forming powder is limited to the range of from 4 to 25% by weight.

C: C contained in the hard phase forming powder forms Cr carbide with Cr and serves as a core of the hard phase to contribute to the improvement in wear resistance. If the C content contained in the hard phase forming powder is less than 0.25% by weight with respect to the weight of the total hard phase forming powder, the carbide is insufficiently precipitated and is thus unable to contribute to the improvement in wear resistance. In contrast, if it is more than 2.4% by weight, the formed carbide is increased, promoting wear of the counterpart component element, and the powder is hardened, deteriorating the compacting property. For this reason, the C content contained in the hard phase forming powder is limited to the range of 0.25 to 2.4% by weight.

(3) Weight Ratio of Matrix Forming Powder and Hard Phase Forming Powder

The hard phase consisting of the hard phase forming powder forms the core of Cr carbide at remaining powder portion, and this core is surrounded by a soft ferrite phase or a soft mixed phase of ferrite and austenite in which Cr is diffused from the powder. As previously described, the hard phase serves to improve wear resistance and prevent deterioration of the mechanical strength owing to the presence of the mixed phase which has a high degree of toughness. If the addition amount of the hard phase forming powder is less than 15% by weight with respect to the weight of the total mixed power, the amount of the hard phase formed is insufficient and is thus unable to contribute to improvement in wear resistance. Even if the addition amount is more than 35% by weight, no further improvement in wear resistance is obtainable. In addition, a ferrite phase or a mixed phase of austenite and ferrite which are soft and high in the concentration of Cr is increased, decreasing the mechanical strength and deteriorating the compacting property. For this reason, the addition amount of the hard phase forming powder is limited to the range of 15 to 35% by weight with respect to the weight of the total mixed powder.

(4) Adjusting Area Ratio of Austenite

In order to reduce the ratio of austenite in the metallographic structure and increase the ratio of martensite therein, it is the most convenient to increase the cooling rate after sintering. If the Ni content in the matrix forming powder is high, the ratio of the remaining austenite increases. In this case, it can be transformed into martensite by the subzero treatment described below. Alternatively, by using primarily pre-alloyed powder consisting of Fe and Ni, as the Ni in the matrix forming powder, the diffusion of Ni is made further uniform, thereby reducing the ratio of austenite. The sintered alloy having superior wear resistance which is produced by using a mixed powder consisting of the matrix forming powder or the hard phase forming powder in the above-described amounts, has an overall composition consisting of, in percent by weight, Ni in an amount of 6.0 to 25.0%, Cr in an amount of 0.6 to 8.75%, C in an amount of 0.54 to 2.24%, and the balance consisting of Fe, the sintered alloy exhibiting a metallographic structure in which the hard phase is dispersed in a mixed structure of martensite and austenite, the hard phase comprising a core consisting of Cr carbide, and a ferrite phase diffused Cr, or a mixed phase of ferrite and austenite diffused Cr, surrounding the core, and the area ratio of austenite in the mixed structure in the metallographic structure ranges from 5 to 30%.

Here, as a hard phase forming powder, an alloy powder consisting of, in percent by weight, Cr in an amount of 4.0 to 25.0%, C in an amount of 0.25 to 2.4%, at least one of Mo in an amount of 0.3 to 3.0%; V in an amount of 0.2 to 2.2%; and W in an amount of 1.0 to 5.0%, and the balance consisting of Fe and inevitable impurity, can be preferably employed.

The process of manufacture for a sintered alloy having superior wear resistance, using the above alloy powder, is characterized in that at least one of Mo, V, and W is added into the matrix forming powder in the above-described process of manufacture therefor. The sintered alloy having superior wear resistance produced by using this matrix forming powder consisting of, in percent by weight, Ni in an amount of 6.0 to 25.0%, Cr in an amount of 0.6 to 8.75%, C in an amount of 0.54 to 2.24%, at least one of Mo in an amount of 0.05 to 1.05%; V in an amount of 0.03 to 0.77%; and W in an amount of 0.15 to 0.75%, and the balance consisting of Fe, the sintered alloy exhibiting a metallographic structure in which a hard phase is dispersed in a mixed structure of martensite and austenite, the hard phase comprising a core consisting of Cr carbide, and a ferrite phase diffused Cr, or a mixed phase of ferrite and austenite diffused Cr, surrounding the core, and an area ratio of austenite in the mixed structure in the metallographic structure ranges from 5 to 30%.

Powders of Lead, Manganese Sulfide, Boron Nitride, and Magnesium Metasilicate Mineral In order to improve the machinability of the sintered alloy having superior wear resistance according to the present invention, at least one of a lead powder, a manganese sulfide powder, a boron nitride powder, and a magnesium metasilicate mineral powder in an amount of 0.1 to 2.0% by weight can be added to the mixed powder. The basis for the numerical limitations of this addition amount is as described previously.

Content of Lead, Copper, Copper Alloy, or Acrylic Resin

Lead, copper, a copper alloy, or an acrylic resin may be infiltrated or impregnated into pores formed in a sintered alloy having superior wear resistance according to the present invention. Specifically, these metals can be infiltrated or impregnated into the pores by adding powders of lead, copper or a copper alloy, to the mixed powder and then sintering a compact of the powders. Alternatively, an acrylic resin can be filled (impregnated) in the pores by filling a melted the acrylic resin and the sintered alloy having superior wear resistance into a hermetically closed container and then reducing the pressure in the container. It is also acceptable for these metals to be infiltrated into the pores by using a melted lead, copper or a copper alloy, instead of the acrylic resin.

Subzero Treatment

A sintered alloy having superior wear resistance according to the present invention is subjected to subzero treatment so that the austenite remaining at room temperature is partly converted into martensite having a large mechanical strength. By doing so, the strength and the wear resistance can be further improved. It should be noted, however, that when the acrylic resin is impregnated, the subzero treatment must be applied before the resin is impregnated in order to prevent the impregnated resin from being deteriorated by the subzero treatment.

DETAILED DESCRIPTION OF THE PREFERRED EMBODIMENTS

Figure 1:
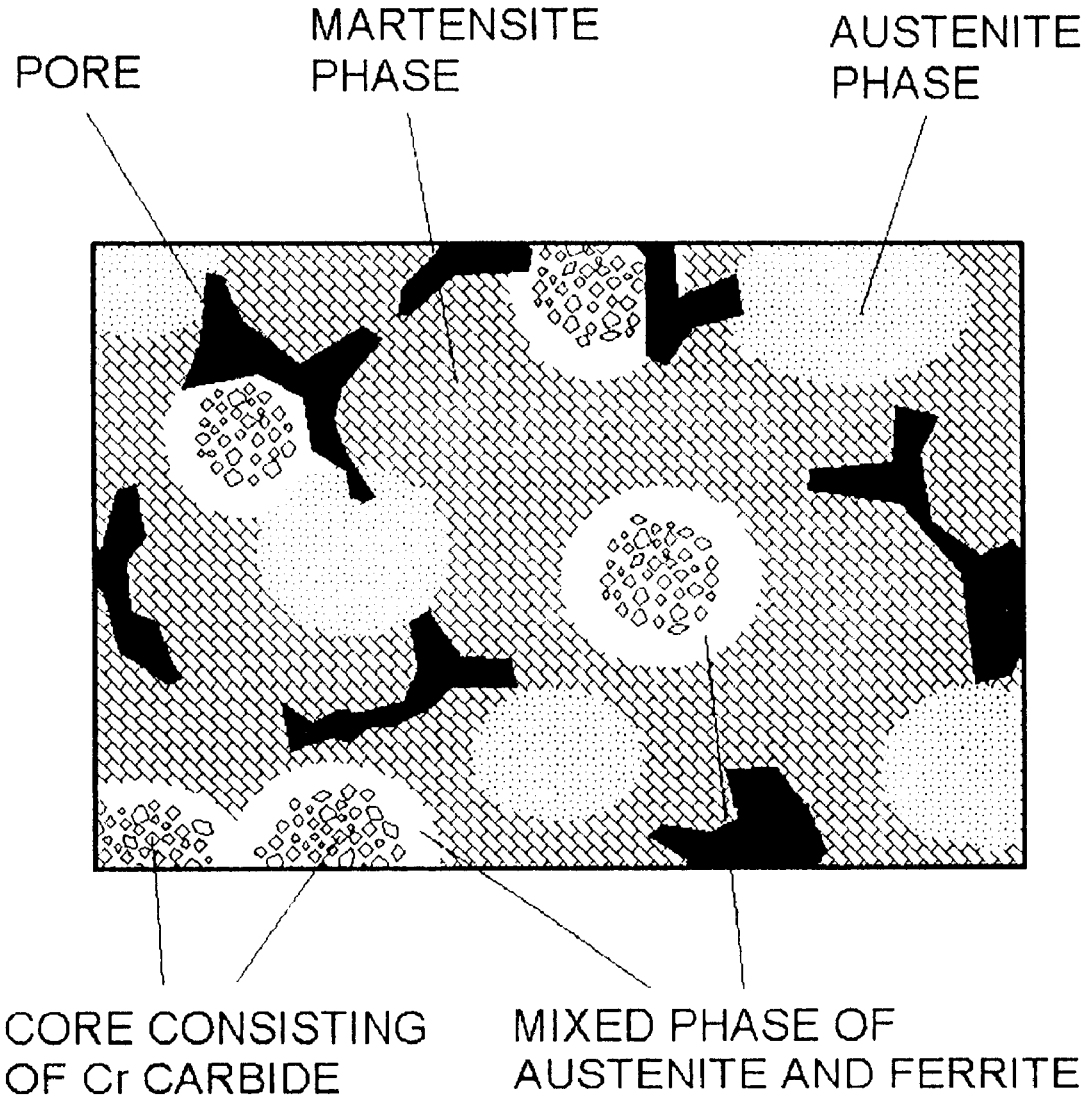
FIG. 1 is a view schematically showing the metallographic structure of a sintered alloy having superior wear resistance according to the present invention.

Embodiments of the present invention will be described below.

First Embodiment

As matrix forming powders, partially Ni diffused Fe powders shown in Table 1, Fe—Ni alloy powders (pre-alloy powders) shown in Table 2, simple Ni powder, simple Fe powder, and graphite powder were prepared. As hard phase forming powders, alloy powders shown in Table 3 were prepared.

TABLE 1

| Partially Ni Diffused Fe Powder | | |
|---|---|---|
| | Fe | Ni |
| A1 | 98.00 | 2.00 |
| A2 | 96.00 | 4.00 |
| A3 | 92.00 | 8.00 |
| A4 | 86.50 | 13.50 |
| A5 | 80.00 | 20.00 |

TABLE 2

| Fe-Ni Alloy Powder | | |
|---|---|---|
| | Fe | Ni |
| A6 | 98.00 | 2.00 |
| A7 | 96.00 | 4.00 |
| A8 | 92.00 | 8.00 |
| A9 | 88.00 | 12.00 |
| A10 | 87.00 | 13.00 |
| A11 | 86.50 | 13.50 |

TABLE 3

| Hard Phase Forming Powder | | | | | | |
|---|---|---|---|---|---|---|
| | Fe | Cr | Mo | V | W | C |
| B1 | 95.60 | 3.00 | | | | 1.40 |
| B2 | 94.60 | 4.00 | | | | 1.40 |
| B3 | 88.60 | 10.00 | | | | 1.40 |
| B4 | 83.60 | 15.00 | | | | 1.40 |
| B5 | 78.60 | 20.00 | | | | 1.40 |
| B6 | 73.60 | 25.00 | | | | 1.40 |
| B7 | 68.60 | 30.00 | | | | 1.40 |
| B8 | 84.80 | 15.00 | | | | 0.20 |
| B9 | 84.75 | 15.00 | | | | 0.25 |
| B10 | 84.50 | 15.00 | | | | 0.50 |
| B11 | 84.00 | 15.00 | | | | 1.00 |
| B12 | 83.00 | 15.00 | | | | 2.00 |
| B13 | 82.60 | 15.00 | | | | 2.40 |
| B14 | 82.40 | 15.00 | | | | 2.60 |
| B15 | 83.50 | 15.00 | 0.10 | | | 1.40 |
| B16 | 83.30 | 15.00 | 0.30 | | | 1.40 |
| B17 | 83.10 | 15.00 | 0.50 | | | 1.40 |
| B18 | 82.60 | 15.00 | 1.00 | | | 1.40 |
| B19 | 82.10 | 15.00 | 1.50 | | | 1.40 |
| B20 | 81.60 | 15.00 | 2.00 | | | 1.40 |
| B21 | 81.10 | 15.00 | 2.50 | | | 1.40 |
| B22 | 80.60 | 15.00 | 3.00 | | | 1.40 |
| B23 | 80.10 | 15.00 | 3.50 | | | 1.40 |
| B24 | 83.50 | 15.00 | | 0.10 | | 1.40 |
| B25 | 83.40 | 15.00 | | 0.20 | | 1.40 |
| B26 | 83.10 | 15.00 | | 0.50 | | 1.40 |
| B27 | 82.60 | 15.00 | | 1.00 | | 1.40 |
| B28 | 82.10 | 15.00 | | 1.50 | | 1.40 |
| B29 | 81.60 | 15.00 | | 2.00 | | 1.40 |
| B30 | 81.40 | 15.00 | | 2.20 | | 1.40 |
| B31 | 81.10 | 15.00 | | 2.50 | | 1.40 |
| B32 | 83.10 | 15.00 | | | 0.50 | 1.40 |
| B33 | 82.60 | 15.00 | | | 1.00 | 1.40 |
| B34 | 81.60 | 15.00 | | | 2.00 | 1.40 |
| B35 | 80.60 | 15.00 | | | 3.00 | 1.40 |
| B36 | 79.60 | 15.00 | | | 4.00 | 1.40 |
| B37 | 78.60 | 15.00 | | | 5.00 | 1.40 |
| B38 | 77.60 | 15.00 | | | 6.00 | 1.40 |
| B39 | 82.10 | 15.00 | 1.00 | 0.50 | | 1.40 |
| B40 | 80.60 | 15.00 | 1.00 | | 2.00 | 1.40 |
| B41 | 81.10 | 15.00 | | 0.50 | 2.00 | 1.40 |
| B42 | 73.40 | 15.00 | 3.00 | 2.20 | 5.00 | 1.40 |

These powders were mixed at mixing ratio shown in Tables 4 and 5, and mixed powders (alloys Nos. 1 to 76) were produced. These mixed powders were compacted into cylindrical form having outer diameters of 50 mm, inner diameters of 45 mm, and heights of 10 mm, at a compacting pressure of 6.5 ton/cm$^2$, and were sintered by heating at 1180° C. for 60 minutes in a dissociated ammonia gas atmosphere, and alloys (alloys Nos. 1 to 76) having constituent compositions shown in Tables 6 and 7 were obtained. After sintering, most of the alloys were the subjected to subzero treatment by dipping in liquid nitrogen. The immersion time (in minutes) are shown in Tables 4 and 5.

TABLE 4

| Sample | Matrix Forming Powder | | | | | | | Infiltration | | | |
|---|---|---|---|---|---|---|---|---|---|---|---|
| | Fe | Ni | Partially Ni Diffused Fe Powder | | Fe—Ni Alloy Powder | | Graphite | Hard Phase Forming Powder | | / Impregna- | Subzero Treatment |
| No. | Powder | Powder | Powder No. | | Powder No. | | Powder | Powder No. | | tion | min |
| Alloy 1 | 70.00 | 4.00 | | | | | 1.00 | 25.00 | B39 | — | 10.0 |
| Alloy 2 | 68.00 | 6.00 | | | | | 1.00 | 25.00 | B39 | — | 10.0 |
| Alloy 3 | 64.00 | 10.00 | | | | | 1.00 | 25.00 | B39 | — | 10.0 |
| Alloy 4 | 59.00 | 15.00 | | | | | 1.00 | 25.00 | B39 | — | 10.0 |
| Alloy 5 | 54.00 | 20.00 | | | | | 1.00 | 25.00 | B39 | — | 10.0 |
| Alloy 6 | 49.00 | 25.00 | | | | | 1.00 | 25.00 | B39 | — | 10.0 |
| Alloy 7 | 47.00 | 27.00 | | | | | 1.00 | 25.00 | B39 | — | 10.0 |
| Alloy 8 | | 8.69 | 65.31 | A1 | | | 1.00 | 25.00 | B39 | — | 10.0 |
| Alloy 9 | | 7.33 | 66.67 | A2 | | | 1.00 | 25.00 | B39 | — | 10.0 |
| Alloy 10 | | 4.43 | 69.57 | A3 | | | 1.00 | 25.00 | B39 | — | 10.0 |
| Alloy 11 | | | 74.00 | A4 | | | 1.00 | 25.00 | B39 | — | 10.0 |
| Alloy 12 | 24.00 | | 50.00 | A5 | | | 1.00 | 25.00 | B39 | — | 10.0 |
| Alloy 13 | | 8.69 | | | 65.31 | A6 | 1.00 | 25.00 | B39 | — | 10.0 |
| Alloy 14 | | 7.33 | | | 66.67 | A7 | 1.00 | 25.00 | B39 | — | 10.0 |
| Alloy 15 | | 4.43 | | | 69.57 | A8 | 1.00 | 25.00 | B39 | — | 10.0 |
| Alloy 16 | | 1.27 | | | 72.73 | A9 | 1.00 | 25.00 | B39 | — | 0.0 |
| Alloy 17 | | 0.43 | | | 73.57 | A10 | 1.00 | 25.00 | B39 | — | 0.0 |
| Alloy 18 | | | | | 74.00 | A11 | 1.00 | 25.00 | B39 | — | 0.0 |
| Alloy 19 | | 1.27 | | | 72.73 | A9 | 1.00 | 25.00 | B39 | — | 1.0 |
| Alloy 20 | | 1.27 | | | 72.73 | A9 | 1.00 | 25.00 | B39 | — | 0.5 |
| Alloy 21 | 49.00 | 25.00 | | | | | 1.00 | 25.00 | B39 | — | 7.0 |
| Alloy 22 | 49.00 | 25.00 | | | | | 1.00 | 25.00 | B39 | — | 5.0 |
| Alloy 23 | 49.00 | 25.00 | | | | | 1.00 | 25.00 | B39 | — | 1.0 |
| Alloy 24 | 49.00 | 25.00 | | | | | 1.00 | 25.00 | B39 | — | 0.5 |
| Alloy 25 | 64.60 | 10.00 | | | | | 0.40 | 25.00 | B39 | — | 10.0 |
| Alloy 26 | 64.50 | 10.00 | | | | | 0.50 | 25.00 | B39 | — | 10.0 |
| Alloy 27 | 64.20 | 10.00 | | | | | 0.80 | 25.00 | B39 | — | 10.0 |
| Alloy 28 | 63.80 | 10.00 | | | | | 1.20 | 25.00 | B39 | — | 10.0 |
| Alloy 29 | 63.60 | 10.00 | | | | | 1.40 | 25.00 | B39 | — | 10.0 |
| Alloy 30 | 63.40 | 10.00 | | | | | 1.60 | 25.00 | B39 | — | 10.0 |
| Alloy 31 | 79.00 | 10.00 | | | | | 1.00 | 10.00 | B39 | — | 10.0 |
| Alloy 32 | 74.00 | 10.00 | | | | | 1.00 | 15.00 | B39 | — | 10.0 |
| Alloy 33 | 69.00 | 10.00 | | | | | 1.00 | 20.00 | B39 | — | 10.0 |
| Alloy 34 | 59.00 | 10.00 | | | | | 1.00 | 35.00 | B39 | — | 10.0 |
| Alloy 35 | 54.00 | 10.00 | | | | | 1.00 | 40.00 | B39 | — | 10.0 |
| Alloy 36 | 64.00 | 10.00 | | | | | 1.00 | 25.00 | B1 | — | 10.0 |
| Alloy 37 | 64.00 | 10.00 | | | | | 1.00 | 25.00 | B2 | — | 10.0 |
| Alloy 38 | 64.00 | 10.00 | | | | | 1.00 | 25.00 | B3 | — | 10.0 |

TABLE 5

| Sample | Matrix Forming Powder | | | | | | | Infiltration | | | |
|---|---|---|---|---|---|---|---|---|---|---|---|
| | Fe | Ni | Partially Ni Diffused Fe Powder | | Fe—Ni Alloy Powder | | Graphite | Hard Phase Forming Powder | | / Impregna- | Subzero Treatment |
| No. | Powder | Powder | Powder No. | | Powder No. | | Powder | Powder No. | | tion | min |
| Alloy 39 | 64.00 | 10.00 | | | | | 1.00 | 25.00 | B4 | — | 10.0 |
| Alloy 40 | 64.00 | 10.00 | | | | | 1.00 | 25.00 | B5 | — | 10.0 |
| Alloy 41 | 64.00 | 10.00 | | | | | 1.00 | 25.00 | B6 | — | 10.0 |
| Alloy 42 | 64.00 | 10.00 | | | | | 1.00 | 25.00 | B7 | — | 10.0 |
| Alloy 43 | 64.00 | 10.00 | | | | | 1.00 | 25.00 | B8 | — | 10.0 |
| Alloy 44 | 64.00 | 10.00 | | | | | 1.00 | 25.00 | B9 | — | 10.0 |
| Alloy 45 | 64.00 | 10.00 | | | | | 1.00 | 25.00 | B10 | — | 10.0 |
| Alloy 46 | 64.00 | 10.00 | | | | | 1.00 | 25.00 | B11 | — | 10.0 |
| Alloy 47 | 64.00 | 10.00 | | | | | 1.00 | 25.00 | B12 | — | 10.0 |
| Alloy 48 | 64.00 | 10.00 | | | | | 1.00 | 25.00 | B13 | — | 10.0 |
| Alloy 49 | 64.00 | 10.00 | | | | | 1.00 | 25.00 | B14 | — | 10.0 |
| Alloy 50 | 64.00 | 10.00 | | | | | 1.00 | 25.00 | B15 | — | 10.0 |
| Alloy 51 | 64.00 | 10.00 | | | | | 1.00 | 25.00 | B16 | — | 10.0 |

TABLE 5-continued

| Sample No. | Matrix Forming Powder: Fe Powder | Ni Powder | Partially Ni Diffused Fe Powder: Powder No. | Fe—Ni Alloy Powder: Powder No. | Graphite Powder | Hard Phase Forming Powder | Powder No. | Infiltration / Impregnation | Subzero Treatment min |
|---|---|---|---|---|---|---|---|---|---|
| Alloy 52 | 64.00 | 10.00 | | | 1.00 | 25.00 | B17 | — | 10.0 |
| Alloy 53 | 64.00 | 10.00 | | | 1.00 | 25.00 | B18 | — | 10.0 |
| Alloy 54 | 64.00 | 10.00 | | | 1.00 | 25.00 | B19 | — | 10.0 |
| Alloy 55 | 64.00 | 10.00 | | | 1.00 | 25.00 | B20 | — | 10.0 |
| Alloy 56 | 64.00 | 10.00 | | | 1.00 | 25.00 | B21 | — | 10.0 |
| Alloy 57 | 64.00 | 10.00 | | | 1.00 | 25.00 | B22 | — | 10.0 |
| Alloy 58 | 64.00 | 10.00 | | | 1.00 | 25.00 | B23 | — | 10.0 |
| Alloy 59 | 64.00 | 10.00 | | | 1.00 | 25.00 | B24 | — | 10.0 |
| Alloy 60 | 64.00 | 10.00 | | | 1.00 | 25.00 | B25 | — | 10.0 |
| Alloy 61 | 64.00 | 40.00 | | | 1.00 | 25.00 | B26 | — | 10.0 |
| Alloy 62 | 64.00 | 10.00 | | | 1.00 | 25.00 | B27 | — | 10.0 |
| Alloy 63 | 64.00 | 10.00 | | | 1.00 | 25.00 | B28 | — | 10.0 |
| Alloy 64 | 64.00 | 10.00 | | | 1.00 | 25.00 | B29 | — | 10.0 |
| Alloy 65 | 64.00 | 10.00 | | | 1.00 | 25.00 | B30 | — | 10.0 |
| Alloy 66 | 64.00 | 10.00 | | | 1.00 | 25.00 | B31 | — | 10.0 |
| Alloy 67 | 64.00 | 10.00 | | | 1.00 | 25.00 | B32 | — | 10.0 |
| Alloy 68 | 64.00 | 10.00 | | | 1.00 | 25.00 | B33 | — | 10.0 |
| Alloy 69 | 64.00 | 10.00 | | | 1.00 | 25.00 | B34 | — | 10.0 |
| Alloy 70 | 64.00 | 10.00 | | | 1.00 | 25.00 | B35 | — | 10.0 |
| Alloy 71 | 64.00 | 10.00 | | | 1.00 | 25.00 | B36 | — | 10.0 |
| Alloy 72 | 64.00 | 10.00 | | | 1.00 | 25.00 | B37 | — | 10.0 |
| Alloy 73 | 64.00 | 10.00 | | | 1.00 | 25.00 | B38 | — | 10.0 |
| Alloy 74 | 64.00 | 10.00 | | | 1.00 | 25.00 | B40 | — | 10.0 |
| Alloy 75 | 64.00 | 10.00 | | | 1.00 | 25.00 | B41 | — | 10.0 |
| Alloy 76 | 64.00 | 10.00 | | | 1.00 | 25.00 | B42 | — | 10.0 |

TABLE 6

| Sample No. | Overall Constituent Composition: Fe Powder | Ni Powder | Cr Powder | Mo Powder | V Powder | C Powder | γ Amount % | Comments |
|---|---|---|---|---|---|---|---|---|
| Alloy 1 | 90.53 | 4.00 | 3.75 | 0.25 | 0.13 | 1.35 | 5.7 | Outside lower limit of Ni content |
| Alloy 2 | 88.53 | 6.00 | 3.75 | 0.25 | 0.13 | 1.35 | 7.7 | Within lower limit of Ni content |
| Alloy 3 | 84.53 | 10.00 | 3.75 | 0.25 | 0.13 | 1.35 | 12.2 | Standard |
| Alloy 4 | 79.53 | 15.00 | 3.75 | 0.25 | 0.13 | 1.35 | 17.1 | |
| Alloy 5 | 74.53 | 20.00 | 3.75 | 0.25 | 0.13 | 1.35 | 23.2 | |
| Alloy 6 | 69.53 | 25.00 | 3.75 | 0.25 | 0.13 | 1.35 | 28.9 | Within upper limit of Ni content |
| Alloy 7 | 67.53 | 27.00 | 3.75 | 0.25 | 0.13 | 1.35 | 30.8 | outside upper limit of Ni content |
| Alloy 8 | 84.53 | 10.00 | 3.75 | 0.25 | 0.13 | 1.35 | 11.4 | Partiatly Ni diffused Fe powder + Ni powder |
| Alloy 9 | 84.53 | 10.00 | 3.75 | 0.25 | 0.13 | 1.35 | 10.9 | Partially Ni diffused Fe powder + Ni powder |
| Alloy 10 | 84.53 | 10.00 | 3.75 | 0.25 | 0.13 | 1.35 | 9.2 | Partially Ni diffused Fe powder + Ni powder |
| Alloy 11 | 84.54 | 9.99 | 3.75 | 0.25 | 0.13 | 1.35 | 7.1 | Partially Ni diffused Fe powder |
| Alloy 12 | 84.53 | 10.00 | 3.75 | 0.25 | 0.13 | 1.35 | 9.5 | Partially Ni diffused Fe powder + Fe powder |
| Alloy 13 | 84.53 | 10.00 | 3.75 | 0.25 | 0.13 | 1.35 | 10.7 | Fe—Ni alloy powder + Ni powder |
| Alloy 14 | 84.53 | 10.00 | 3.75 | 0.25 | 0.13 | 1.35 | 9.5 | Fe—Ni alloy powder + Ni powder |
| Alloy 15 | 84.53 | 10.00 | 3.75 | 0.25 | 0.13 | 1.35 | 7.5 | Fe—Ni alloy powder + Ni powder |
| Alloy 16 | 84.53 | 10.00 | 3.75 | 0.25 | 0.13 | 1.35 | 5.4 | Fe—Ni alloy powder + Ni powder |
| Alloy 17 | 84.53 | 9.99 | 3.75 | 0.25 | 0.13 | 1.35 | 4.4 | Fe—Ni alloy powder + Ni powder, outside lower limit of γ amount |
| Alloy 18 | 84.54 | 9.99 | 3.75 | 0.25 | 0.13 | 1.35 | 4.1 | Fe—Ni alloy powder, outside lower limit of γ amount |
| Alloy 19 | 84.53 | 10.00 | 3.75 | 0.25 | 0.13 | 1.35 | 3.2 | Outside lower limit of γ amount |
| Alloy 20 | 84.53 | 10.00 | 3.75 | 0.25 | 0.13 | 1.35 | 4.1 | Outside lower limit of γ amount |
| Alloy 21 | 69.53 | 25.00 | 3.75 | 0.25 | 0.13 | 1.35 | 29.2 | |
| Alloy 22 | 69.53 | 25.00 | 3.75 | 0.25 | 0.13 | 1.35 | 30.4 | |
| Alloy 23 | 69.53 | 25.00 | 3.75 | 0.25 | 0.13 | 1.35 | 37.7 | Within upper limit of γ amount |
| Alloy 24 | 69.53 | 25.00 | 3.75 | 0.25 | 0.13 | 1.35 | 42.4 | Outside upper limit of γ amount |
| Alloy 25 | 85.13 | 10.00 | 3.75 | 0.25 | 0.13 | 0.75 | 13.8 | Outside lower limit of Graphite content |
| Alloy 26 | 85.03 | 10.00 | 3.75 | 0.25 | 0.13 | 0.85 | 13.3 | Within lower limit of Graphite content |
| Alloy 27 | 84.73 | 10.00 | 3.75 | 0.25 | 0.13 | 1.15 | 12.6 | |
| Alloy 28 | 84.33 | 10.00 | 3.75 | 0.25 | 0.13 | 1.55 | 12.1 | |
| Alloy 29 | 84.13 | 10.00 | 3.75 | 0.25 | 0.13 | 1.75 | 11.8 | Within upper limit of Graphite content |
| Alloy 30 | 83.93 | 10.00 | 3.75 | 0.25 | 0.13 | 1.95 | 11.4 | Outside upper limit of Graphite content |
| Alloy 31 | 87.21 | 10.00 | 1.50 | 0.10 | 0.05 | 1.14 | 11.7 | Outside lower limit of Hard Phase Forming Powder content |

TABLE 6-continued

| Sample No. | Overall Constituent Composition Fe Powder | Ni Powder | Cr Powder | Mo Powder | V Powder | C Powder | γ Amount % | Comments |
|---|---|---|---|---|---|---|---|---|
| Alloy 32 | 86.32 | 10.00 | 2.25 | 0.15 | 0.08 | 1.21 | 11.7 | Within lower limit of Hard Phase Forming Powder content |
| Alloy 33 | 85.42 | 10.00 | 3.00 | 0.20 | 0.10 | 1.28 | 11.9 | |
| Alloy 34 | 83.63 | 10.00 | 5.25 | 0.35 | 0.18 | 1.49 | 13.7 | Within upper limit of Hard Phase Forming Powder Content |
| Alloy 35 | 82.74 | 10.00 | 6.00 | 0.40 | 0.20 | 1.56 | 14.2 | Outside upper limit of Hard Phase Forming Powder content |
| Alloy 36 | 87.90 | 10.00 | 0.75 | | | 1.35 | 11.0 | Outside lower limit of Cr content in Hard Phase |
| Alloy 37 | 87.65 | 10.00 | 1.00 | | | 1.35 | 11.4 | Within lower limit of Cr content in Hard Phase |
| Alloy 38 | 86.15 | 10.00 | 2.50 | | | 1.35 | 12.0 | |

TABLE 7

| Sample No. | Overall Constituent Composition Fe Powder | Ni Powder | Cr Powder | Mo Powder | V Powder | C Powder | γ Amount % | Comments |
|---|---|---|---|---|---|---|---|---|
| Alloy 39 | 84.90 | 10.00 | 3.75 | | | 1.35 | 12.3 | |
| Alloy 40 | 83.65 | 10.00 | 5.00 | | | 1.35 | 13.5 | |
| Alloy 41 | 82.40 | 10.00 | 6.25 | | | 1.35 | 14.1 | Within upper limit of Cr content in Hard Phase |
| Alloy 42 | 81.15 | 10.00 | 7.50 | | | 1.35 | 14.6 | Outside upper limit of Cr content in Hard Phase |
| Alloy 43 | 85.20 | 10.00 | 3.75 | | | 1.05 | 13.1 | Outside lower limit of C content in Hard phase |
| Alloy 44 | 85.19 | 10.00 | 3.75 | | | 1.06 | 12.8 | Within lower limit of C content in Hard Phase |
| Alloy 45 | 85.13 | 10.00 | 3.75 | | | 1.13 | 12.6 | |
| Alloy 46 | 85.00 | 10.00 | 3.75 | | | 1.25 | 12.4 | |
| Alloy 47 | 84.75 | 10.00 | 3.75 | | | 1.50 | 12.1 | |
| Alloy 48 | 84.65 | 10.00 | 3.75 | | | 1.60 | 11.9 | Within upper limit of C content in Hard Phase |
| Alloy 49 | 84.60 | 10.00 | 3.75 | | | 1.65 | 11.8 | Outside upper limit of C content in Hard Phase |
| Alloy 50 | 84.88 | 10.00 | 3.75 | 0.03 | | 1.35 | 12.4 | Outside lower limit of Mo content in Hard Phase |
| Alloy 51 | 84.83 | 10.00 | 3.75 | 0.08 | | 1.35 | 12.3 | Within lower limit of Mo conent in Hard Phase |
| Alloy 52 | 84.78 | 10.00 | 3.75 | 0.13 | | 1.35 | 12.3 | |
| Alloy 53 | 84.65 | 10.00 | 3.75 | 0.25 | | 1.35 | 12.4 | |
| Alloy 54 | 84.53 | 10.00 | 3.75 | 0.38 | | 1.35 | 12.4 | |
| Alloy 55 | 84.40 | 10.00 | 3.75 | 0.50 | | 1.35 | 12.4 | |
| Alloy 56 | 84.28 | 10.00 | 3.75 | 0.63 | | 1.35 | 12.5 | |
| Alloy 57 | 84.15 | 10.00 | 3.75 | 0.75 | | 1.35 | 12.5 | Wthin upper limit of Mo content in Hard Phase |
| Alloy 58 | 84.03 | 10.00 | 3.75 | 0.88 | | 1.35 | 12.4 | Outside upper limit of Mo content in Hard Phase |
| Alloy 59 | 84.88 | 10.00 | 3.75 | | 0.03 | 1.35 | 12.4 | Outside lower limit of Mo content in Hard Phase |
| Alloy 60 | 84.85 | 10.00 | 3.75 | | 0.05 | 1.35 | 12.3 | Within lower limit of Mo content in Hard Phase |
| Alloy 61 | 84.78 | 10.00 | 3.75 | | 0.13 | 1.35 | 12.4 | |
| Alloy 62 | 84.65 | 10.00 | 3.75 | | 0.25 | 1.35 | 12.3 | |
| Alloy 63 | 84.53 | 10.00 | 3.75 | | 0.38 | 1.35 | 12.3 | |
| Alloy 64 | 84.40 | 10.00 | 3.75 | | 0.50 | 1.35 | 12.4 | |
| Alloy 65 | 84.35 | 10.00 | 3.75 | | 0.55 | 1.35 | 12.2 | Within upper limit of V content in Hard Phase |
| Alloy 66 | 84.28 | 10.00 | 3.75 | | 0.63 | 1.35 | 12.4 | Outside upper limit of V content in Hard Phase |
| Alloy 67 | 84.78 | 10.00 | 3.75 | | | 1.35 | 12.3 | Outside lower limit of W Content in Hard Phase |
| Alloy 68 | 84.65 | 10.00 | 3.75 | | | 1.35 | 12.3 | Within lower limit of W Content in Hard Phase |
| Alloy 69 | 84.40 | 10.00 | 1.50 | | | 1.35 | 12.2 | |
| Alloy 70 | 84.15 | 10.00 | 2.25 | | | 1.35 | 12.4 | |
| Alloy 71 | 83.90 | 10.00 | 3.00 | | | 1.35 | 12.3 | |
| Alloy 72 | 83.65 | 10.00 | 5.25 | | | 1.35 | 12.2 | Within upper limit of W content in Hard Phase |
| Alloy 73 | 83.40 | 10.00 | 6.00 | | | 1.35 | 12.2 | Outside upper limit of W content in Hard Phase |
| Alloy 74 | 84.28 | 10.00 | 0.75 | | 0.13 | 1.35 | 12.1 | |
| Alloy 75 | 84.15 | 10.00 | 1.00 | 0.25 | | 1.35 | 12.1 | |
| Alloy 76 | 82.35 | 10.00 | 2.50 | 0.75 | 0.55 | 1.35 | 12.2 | Within upper limit of Mo, V and W contents in Hard Phase |

The surfaces of the above alloys were corroded by nital etchant, and the area ratios of austenite in the metal structures were measured by microphotography and are shown in Tables 6 and 7.

The above alloys were subjected to measurements of radial crushing strength and simple wear tests. The results are shown in Tables 8 and 9 and in FIGS. 2 through 11. The simple wear test is a test in which a sintered alloy machined into the valve seat form is press-fitted in an aluminum alloy housing, and the valve is caused to move in an up-and-down pistonlike motion by an eccentric cam rotated by a motor, such that the face of the valve and the face of the valve seat repeatedly impact each other. The temperature setting in this test was carried out by heating the bevel of the valve with a burner in order to simply simulate an environment inside the housing of an engine. In this test, the rotating speed of the eccentric cam was set to 2700 rpm, the test temperature was set to 250° C. at the valve seat portion, and the repetition duration was set to 15 hours. The wear amounts on the valve seats and the valves were measured and evaluated after the tests.

TABLE 8

| Sample No. | γ Amount % | Evaluated Item: Radial Crushing Strength MPa | Wear Amount μm: Valve Seat | Valve | Total | Number of Machined Pores | Comments |
|---|---|---|---|---|---|---|---|
| Alloy 1 | 5.7 | 996 | 66 | 5 | 71 | 29 | Outside lower limit of Ni content |
| Alloy 2 | 7.7 | 1018 | 36 | 6 | 42 | 27 | Within lower limit of Ni content |
| Alloy 3 | 12.2 | 1120 | 28 | 6 | 34 | 25 | Standard |
| Alloy 4 | 17.1 | 1147 | 23 | 6 | 29 | 20 | |
| Alloy 5 | 23.2 | 1133 | 24 | 8 | 32 | 19 | |
| Alloy 6 | 28.9 | 1061 | 31 | 16 | 47 | 18 | Within upper limit of Ni content |
| Alloy 7 | 30.8 | 998 | 63 | 54 | 117 | 21 | Outside upper limit of Ni content |
| Alloy 8 | 11.4 | 1134 | 24 | 7 | 31 | | Partially Ni diffused Fe powder + Ni powder |
| Alloy 9 | 10.9 | 1167 | 23 | 8 | 31 | | Partially Ni diffused Fe powder + Ni powder |
| Alloy 10 | 9.2 | 1175 | 23 | 9 | 32 | | Partially Ni diffused Fe powder + Ni powder |
| Alloy 11 | 7.1 | 1180 | 24 | 13 | 37 | | Partially Ni diffused Fe powder |
| Alloy 12 | 9.5 | 1198 | 23 | 8 | 31 | | Partially Ni diffused Fe powder + Pe powder |
| Alloy 13 | 10.7 | 1173 | 26 | 12 | 38 | | Fe—Ni alloy powder + Ni powder |
| Alloy 14 | 9.5 | 1165 | 26 | 13 | 39 | | Fe—Ni alloy powder + Ni powder |
| Alloy 15 | 7.5 | 1143 | 25 | 12 | 37 | | Fe—Ni alloy powder + Ni powder |
| Alloy 16 | 5.4 | 1137 | 23 | 14 | 37 | | Fe—Ni alloy powder + Ni powder |
| Alloy 17 | 4.4 | 1122 | 29 | 15 | 44 | | Fe—Ni alloy powder + Ni powder, outside lower limit of γ amount |
| Alloy 18 | 4.1 | 1121 | 35 | 18 | 53 | | Fe—Ni alloy powder, outside lower limit of γ amount |
| Alloy 19 | 3.2 | 1146 | 38 | 27 | 65 | | Outside lower limit of γ amount |
| Alloy 20 | 4.1 | 1141 | 28 | 16 | 44 | | Outside lower limit of γ amount |
| Alloy 21 | 29.2 | 1057 | 31 | 16 | 48 | | |
| Alloy 22 | 30.4 | 1044 | 33 | 17 | 50 | | |
| Alloy 23 | 37.7 | 1030 | 48 | 27 | 88 | | Within upper limit of γ amount |
| Alloy 24 | 42.4 | 1016 | 66 | 40 | 119 | | Outside upper limit of γ amount |
| Alloy 25 | 13.8 | 888 | 80 | 4 | 84 | 28 | Outside lower limit of Graphite content |
| Alloy 26 | 13.3 | 949 | 44 | 4 | 48 | 27 | Within lower limit of Graphite content |
| Alloy 27 | 12.6 | 1081 | 33 | 5 | 38 | 26 | |
| Alloy 28 | 12.1 | 1107 | 28 | 6 | 34 | 23 | |
| Alloy 29 | 11.8 | 1063 | 36 | 13 | 49 | 22 | Within upper limit of Graphite content |
| Alloy 30 | 11.4 | 971 | 83 | 61 | 144 | 21 | Outside upper limit of Graphite content |
| Alloy 31 | 11.7 | 1153 | 77 | 3 | 80 | 33 | Outside lower limit of Hard Phase Forming Powder content |
| Alloy 32 | 11.7 | 1146 | 41 | 5 | 46 | 29 | Within lower limit of Hard Phase Forming Powder content |
| Alloy 33 | 11.9 | 1138 | 32 | 6 | 38 | 27 | |
| Alloy 34 | 13.7 | 1063 | 31 | 18 | 49 | 21 | Within upper limit of Hard Phase Forming Powder content |
| Alloy 35 | 14.2 | 987 | 71 | 63 | 134 | 15 | Outside upper limit of Hard Phase Forming Powder content |
| Alloy 36 | 11.0 | 1178 | 64 | 3 | 67 | 30 | Outside lower limit of Cr content in Hard Phase |
| Alloy 37 | 11.4 | 1172 | 46 | 3 | 49 | 28 | Within lower limit of Cr content in Hard Phase |
| Alloy 38 | 12.0 | 1162 | 40 | 4 | 44 | 27 | |

TABLE 9

| Sample No. | γ Amount % | Evaluated Item: Radial Crushing Strength MPa | Wear Amount μm: Valve Seat | Valve | Total | Number of Machined Pores | Comments |
|---|---|---|---|---|---|---|---|
| Alloy 39 | 12.3 | 1146 | 38 | 4 | 42 | 26 | |
| Alloy 40 | 13.5 | 1114 | 36 | 6 | 42 | 23 | |
| Alloy 41 | 14.1 | 1051 | 36 | 13 | 49 | 21 | Within upper limit of Cr content in Hard Phase |
| Alloy 42 | 14.6 | 940 | 61 | 57 | 118 | 19 | Outside upper limit of Cr Content in Hard Phase |
| Alloy 43 | 13.1 | 1169 | 61 | 3 | 64 | | Outside lower limit of C content in Hard Phase |
| Alloy 44 | 12.8 | 1168 | 48 | 3 | 51 | | Within lower limit of C content in Hard Phase |
| Alloy 45 | 12.6 | 1161 | 43 | 4 | 47 | | |

TABLE 9-continued

| Sample | γ Amount | Evaluated Item: Radial Crushing Strength | Wear Amount μm | | | Number of Machined | |
|---|---|---|---|---|---|---|---|
| No. | % | MPa | Valve Seat | Valve | Total | Pores | Comments |
| Alloy 46 | 12.4 | 1153 | 40 | 4 | 44 | | |
| Alloy 47 | 12.1 | 1108 | 35 | 8 | 43 | | |
| Alloy 48 | 11.9 | 1060 | 39 | 16 | 55 | | Within upper limit of C content in Hard Phase |
| Alloy 49 | 11.8 | 988 | 67 | 63 | 130 | | Outside upper limit of C Content in Hard Phase |
| Alloy 50 | 12.4 | 1145 | 32 | 4 | 36 | | Outside lower limit of Mo content in Hard Phase |
| Alloy 51 | 12.3 | 1143 | 31 | 4 | 35 | | Within lower limit of Mo content in Hard Phase |
| Alloy 52 | 12.3 | 1141 | 30 | 5 | 35 | | |
| Alloy 53 | 12.4 | 1138 | 30 | 5 | 35 | | |
| Alloy 54 | 12.4 | 1127 | 30 | 5 | 35 | | |
| Alloy 55 | 12.4 | 1093 | 28 | 7 | 35 | | |
| Alloy 56 | 12.5 | 1056 | 27 | 11 | 38 | | |
| Alloy 57 | 12.5 | 996 | 30 | 18 | 48 | | Within upper limit of Mo content in Hard Phase |
| Alloy 58 | 12.4 | 913 | 64 | 53 | 117 | | Outside upper limit of Mo content in Hard Phase |
| Alloy 59 | 12.4 | 1144 | 31 | 4 | 35 | | Outside lower limit of V content in Hard Phase |
| Alloy 60 | 12.3 | 1138 | 30 | 4 | 34 | | Within lower limit of V content in Hard Phase |
| Alloy 61 | 12.4 | 1129 | 30 | 5 | 35 | | |
| Alloy 62 | 12.3 | 1108 | 30 | 5 | 35 | | |
| Alloy 63 | 12.3 | 1082 | 28 | 6 | 34 | | |
| Alloy 64 | 12.4 | 1034 | 31 | 8 | 39 | | |
| Alloy 65 | 12.2 | 1008 | 34 | 13 | 47 | | Within upper limit of V Content in Hard Phase |
| Alloy 66 | 12.4 | 954 | 59 | 43 | 102 | | Outside upper limit of V content in Hard Phase |
| Alloy 67 | 12.3 | 1123 | 30 | 4 | 34 | | Outside lower limit of W content in Hard Phase |
| Alloy 68 | 12.3 | 1104 | 29 | 5 | 34 | | Within lower limit of W content in Hard Phase |
| Alloy 69 | 12.2 | 1081 | 29 | 5 | 34 | | |
| Alloy 70 | 12.4 | 1037 | 31 | 6 | 37 | | |
| Alloy 71 | 12.3 | 986 | 34 | 6 | 40 | | |
| Alloy 72 | 12.2 | 954 | 36 | 10 | 46 | | Within upper limit of W content in Hard Phase |
| Alloy 73 | 12.2 | 892 | 72 | 47 | 119 | | Outside upper limit of W content in Hard Phase |
| Alloy 74 | 12.1 | 1114 | 28 | 6 | 34 | 25 | |
| Alloy 75 | 12.1 | 1124 | 26 | 6 | 32 | 24 | |
| Alloy 76 | 12.2 | 947 | 31 | 18 | 49 | 23 | Within upper limit of Mo, V, and W contents in Hard Phase |

(1) Effect of Ni Content

Figure 2:
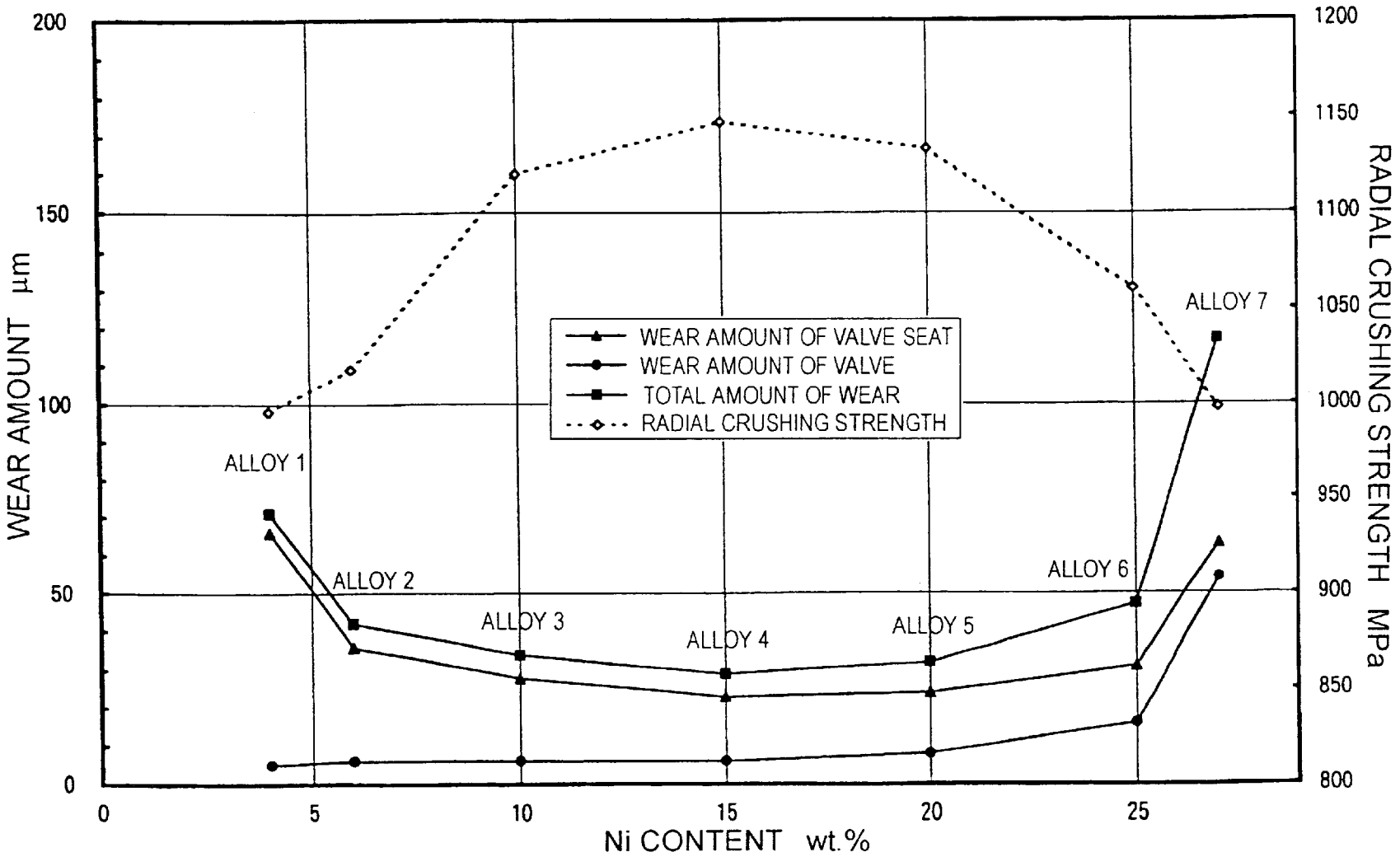
FIG. 2 is a graph showing the relationships between the Ni content, the wear amount, and the radial crushing strength in embodiments of the present invention.
Figure 3:
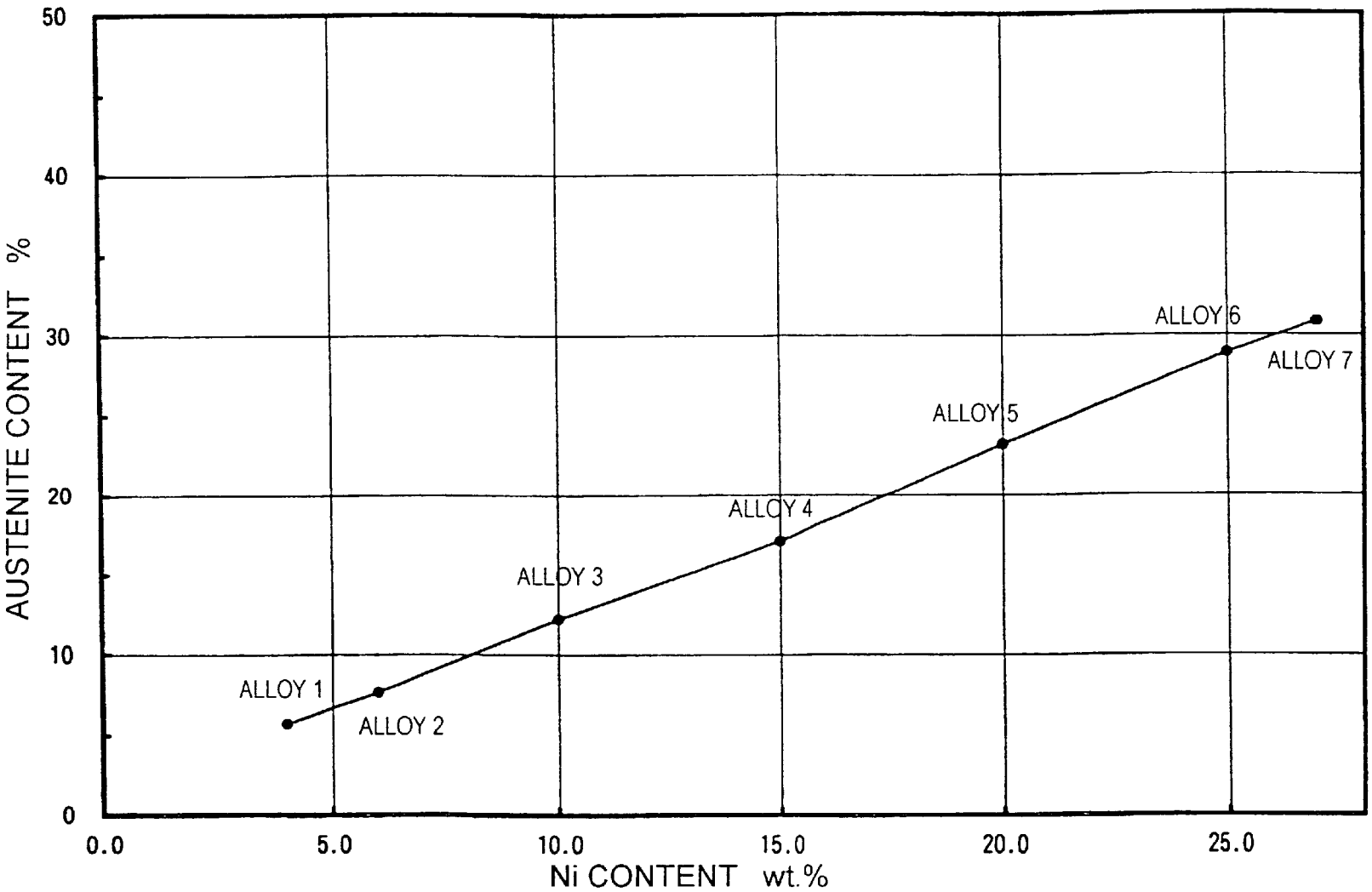
FIG. 3 is a graph showing the relationships between the Ni content and the austenite content in embodiments of the present invention.

FIG. 2 is a graph showing comparisons of the relationships between the wear amounts and the mechanical strength in alloys (alloys Nos. 1 to 7) of differing Ni content, and FIG. 3 is a graph showing the relationships between the Ni content, and the austenite content (area %) therein. The alloys 1 to 7 were subjected to the subzero treatment for 10 minutes. As shown in FIG. 3, the austenite content increases almost linearly with the Ni content, and it was confirmed that the austenite content may be adjusted to range from 5 to 30% by making the Ni content to be 6 to 25% by weight.

As is apparent from FIG. 2, with the increase of the Ni content, the martensite content is increased as the austenite content increases, whereby wear resistance and the mechanical strength of the valve seat is increased with the increase of the Ni content. However, when the Ni content exceeds the range to a certain degree, the matrix strength lowering effect by increasing the austenite content increases more than the improving effect of the mechanical strength and the wear resistance by increasing the martensite content, and the wear resistance and the mechanical strength of the valve seat are lowered.

In the alloy 1 in which the Ni content is less than 6% by weight, the martensite content is insufficient, whereby the wear amount of the valve seat (VS) increases and the radial crushing strength decreases. In the alloy 7 in which the Ni content is more than 25% by weight, as is apparent from FIG. 3, the content of the soft austenite increases too much. As a result, the wear amount of the valve seat increases remarkably with the decrease of the mechanical strength. In contrast, in alloys 2 to 6 in which the Ni content ranges from 6 to 25% by weight according to the present invention and the austenite content ranges from 5 to 30% by weight according to the present invention, the wear amounts of the valve seat and the valve are small and the radial crushing strength is also maintained in suitable ranges.

(2) Effect of Austenite Content

Figure 4:
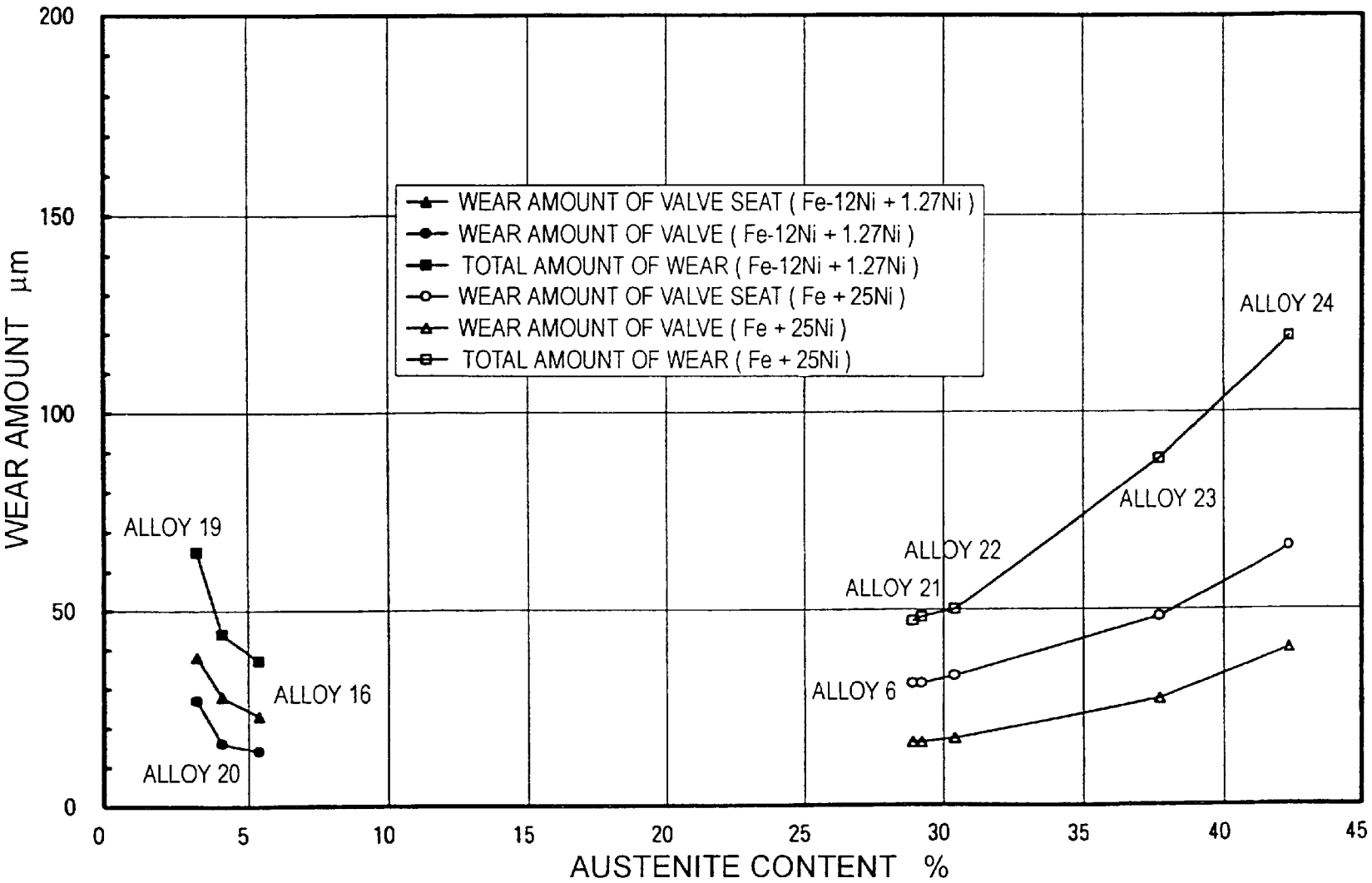
FIG. 4 is a graph showing the relationships between the austenite content and the wear amount in embodiments of the present invention.

FIG. 4 is a graph showing comparisons of the wear amounts of each alloy in two component systems, in which these alloys are adjusted to the same constituent components, only the austenite content differing by altering immersion time in liquid nitrogen during the subzero treatment. As is apparent from FIG. 4, in alloy 19 in which the austenite content is less than 5% by weight, the abrasion of the counterpart component element is high, whereby the wear amount of the valve (V) is large and particles worn from the valves act as abrasive grains, so that the wear amount on the valve seat (VS) is also worsened. In alloys 23 and 24 in which the austenite content is more than 30% by weight, since the content of the soft austenite is large, the wear amount of the valve seat increases remarkably and the wear amount of the valve is also increased by the adhered austenite. In contrast, in alloys 6, 16, and 21, the austenite content ranges from 5 to 30% by weight, whereby the wear amount is small and superior wear resistance is shown. In alloy 22, since the austenite content is 30.4% and is approximately at the upper limit, the wear resistance is sufficient.

(3) Effect of Addition Amount of Graphite Powder

Figure 5:
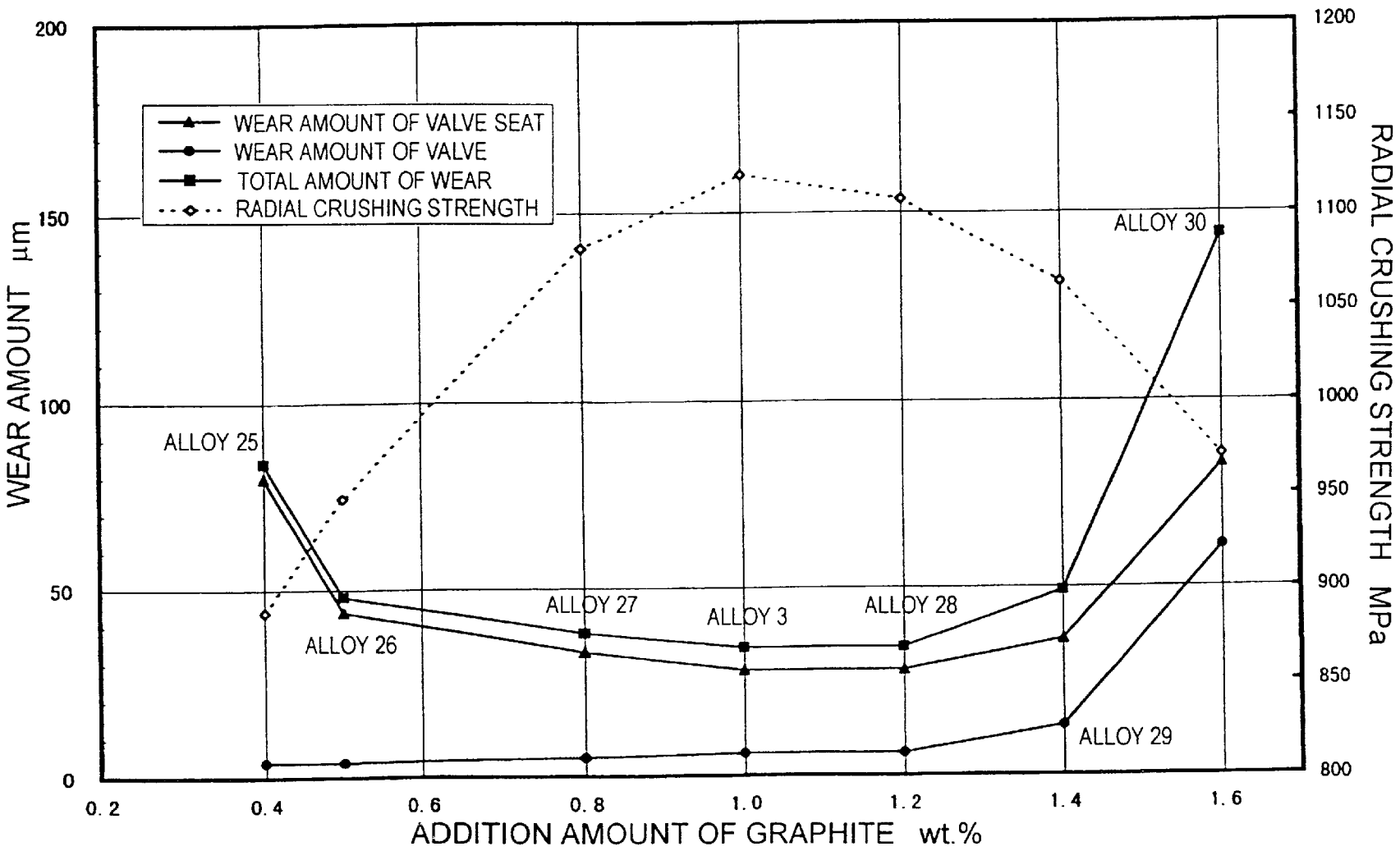
FIG. 5 is a graph showing the relationships between the addition amount of graphite powder, the wear amount, and the radial crushing strength in embodiments of the present invention.

FIG. 5 is a graph showing comparisons of the wear amounts of each alloy at differing addition amounts of graphite powder. As is apparent from FIG. 5, since C of the graphite solid-solution strengthens the matrix and forms carbide, the wear resistance of the valve seat increases with the increase of the addition amount; however, the abrasion of the counterpart component element increases, whereby the wear amount of the valve is worsened. When the addition amount exceeds a certain value, the matrix is weakened by increasing the precipitation of the cementite, and the wear resistance and the mechanical strength are lowered. In this case, the wear amount of the valve seat is also worsened. In alloy 25 in which the addition amount of the graphite powder is less than 0.5% by weight, since the solid-solution strengthening of the matrix and the forming of the hard phase are insufficient, the wear amount of the valve seat (VS) is large and the radial crushing strength is lowered. In alloy 30, in which the addition amount of the graphite powder is more than 1.4% by weight, the wear amounts of the valve and the valve seat increase by precipitating the cementite and the radial crushing strength is also lowered. In contrast, in alloys 26 to 29 in which the addition amount of the graphite ranges from 0.5 to 1.4% by weight according to the present invention, the wear amounts of the valve seat and the valve are small and the radial crushing strength is also maintained in a suitable range.

(4) Effect of Addition Amount of Hard Phase Forming Powder

Figure 6:
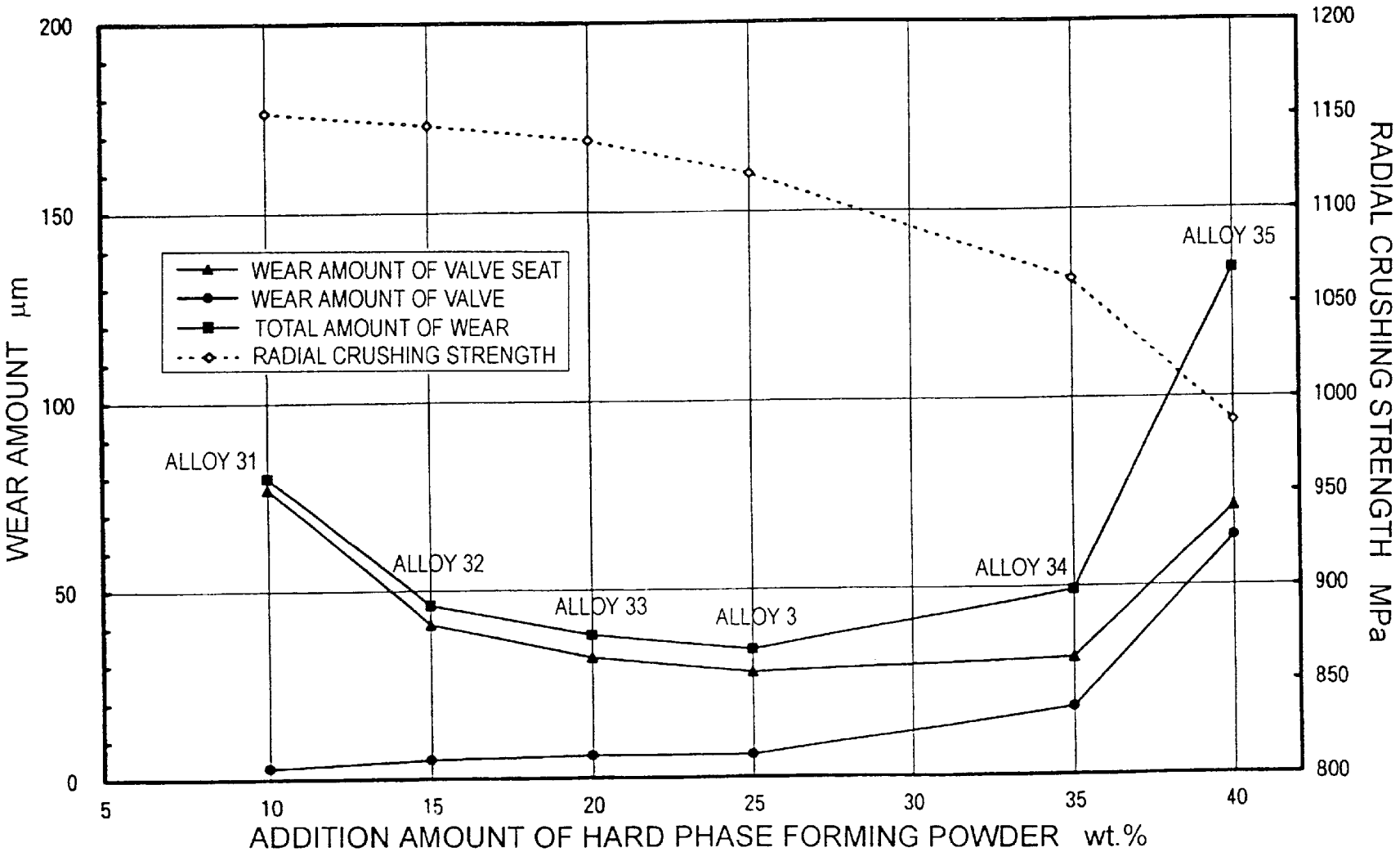
FIG. 6 is a graph showing the relationships between the addition amount of hard phase forming powder, the wear amount, and the radial crushing strength in embodiments of the present invention.

FIG. 6 is a graph showing comparisons of the wear amounts of each alloy at differing addition amounts of hard phase forming powder. As is apparent from FIG. 6, the content of the soft mixed phase consisting of ferrite and austenite increases with the increase in the addition amount of the hard phase forming powder and the compacting property is lowered by hardening the powder. The density of the alloy is thereby lowered, and the mechanical strength of the alloy is gradually lowered. It can also be understood from FIG. 6 that the wear resistance of the valve seat is lowered when the soft mixed phase is too high. In alloy 31, in which the addition amount of the hard phase forming powder is less than 15% by weight, since the forming of the hard phase is insufficient, the wear amount of the valve seat (VS) is large. In alloy 35, in which the addition amount of the hard phase forming powder is more than 35% by weight, the valve wears by increased abrasion of the valve with the increase of the hard phase content cementite. By worn off particles of the valves acting as abrasive grains, by increasing the soft mixed phase, and by lowering the strength of the matrix, the wear amount of the valve seat increases. In contrast, in alloys 32 to 34 in which the addition amount of the hard phase forming powder ranges from 15 to 35% by weight according to the present invention, the radial crushing strength is also maintained in a suitable range and the wear amounts of the valve seat and the valve are lowered.

(5) Effect of Cr Content in Hard Phase Forming Powder

Figure 7:
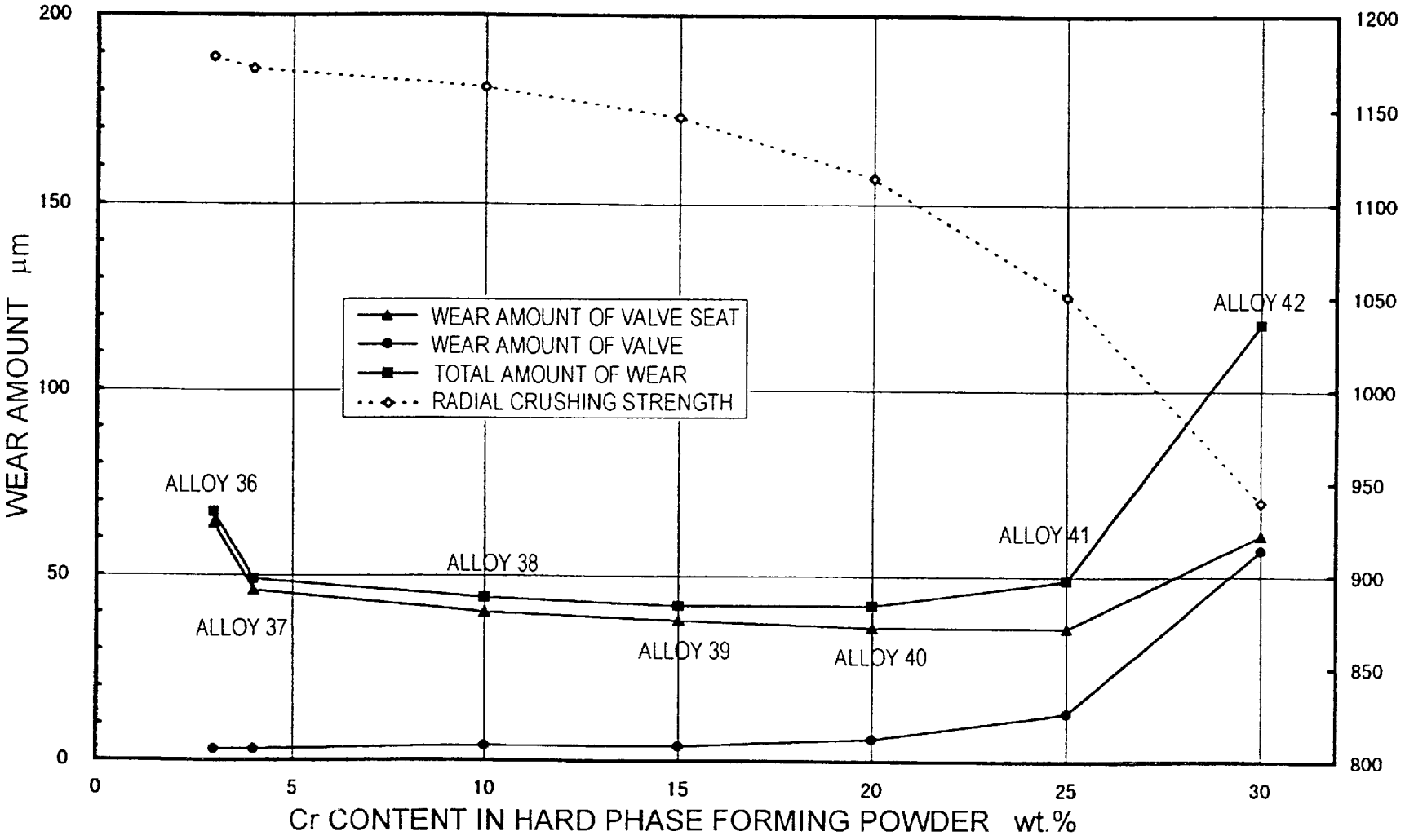
FIG. 7 is a graph showing the relationships between the Cr content in the hard phase forming powder, the wear amount, and the radial crushing strength in embodiments of the present invention.

FIG. 7 is a graph showing comparisons of the wear amounts of each alloy of differing Cr content in the hard phase forming powder. As is apparent from FIG. 7, the hardness of the powder increases with the increase of the Cr content in the hard phase forming powder and the compacting property is lowered. The radial crushing strength of the alloy is thereby gradually lowered. It can also be understood from FIG. 7 that when the Cr content is too high, the wear amount on the valve is promoted by increasing the amount of Cr carbide whereby the wear amount of the valve seat is also worsened. In alloy 36, in which the addition amount of the Cr content in the hard phase forming powder is less than 4% by weight, since the forming of the Cr carbide is insufficient, the wear amount on the valve seat (VS) is large. In alloy 42, in which the addition amount of the Cr content is more than 25% by weight, by decreasing the strength of the matrix with the decrease of the compacting property of the powder, by increasing the wear amount on the valve with the increase of the abrasion of the valve, and by increasing the wear amount of the valve seat by particles worn off from the valve, the wear amounts on the valve seat and the valve increase. In contrast, in alloys 37 to 41 in which the Cr content ranges from 4 to 25% by weight according to the present invention, the wear amounts on the valve seat and the valve are small and the radial crushing strength is also maintained in a suitable range.

(6) Effect of C Content in Hard Phase Forming Powder

Figure 8:
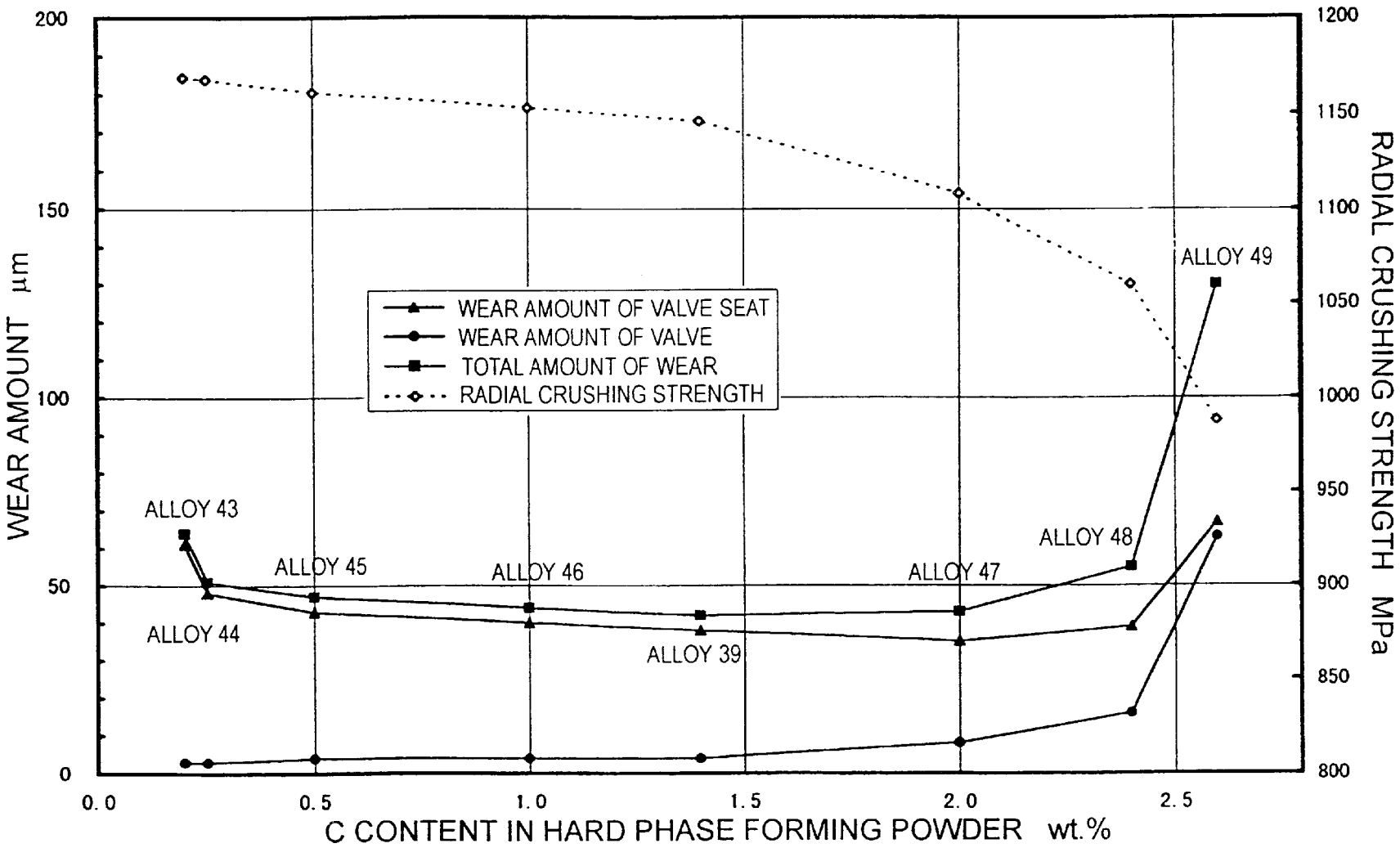
FIG. 8 is a graph showing the relationships between the C content in the hard phase forming powder, the wear amount, and the radial crushing strength in embodiments of the present invention.

FIG. 8 is a graph showing comparisons of the wear amounts of each alloy of differing C content in the hard phase forming powder. As is apparent from FIG. 8, the hardness of the powder increases with the increase of the C content in the hard phase forming powder and the compacting property is lowered. The radial crushing strength of the alloy is thereby gradually lowered. It can also be understood from FIG. 8 that when the C content is too hight, the wear amount on the valve is promoted by increasing the amount of carbide whereby the wear amount on the valve seat is also worsened. In alloy 43, in which the addition amount of the C content in the hard phase forming powder is less than 0.25% by weight, since the formation of the carbide is insufficient, the wear amount on the valve seat (VS) is large. In alloy 49, in which the addition amount of the C content is more than 2.4% by weight, by decreasing the radial crushing strength with the decrease of the compacting property of the powder, by decreasing the strength of the matrix, and by increasing the wear amount on the valve, the wear amount on the valve seat increases. In contrast, in alloys 44 to 48 in which the C content ranges from 0.25 to 2.4% by weight according to the present invention, the wear amounts on the valve seat and the valve are small and the radial crushing strength is also maintained in a suitable range.

(7) Effect of Mo Content in Hard Phase Forming Powder

Figure 9:
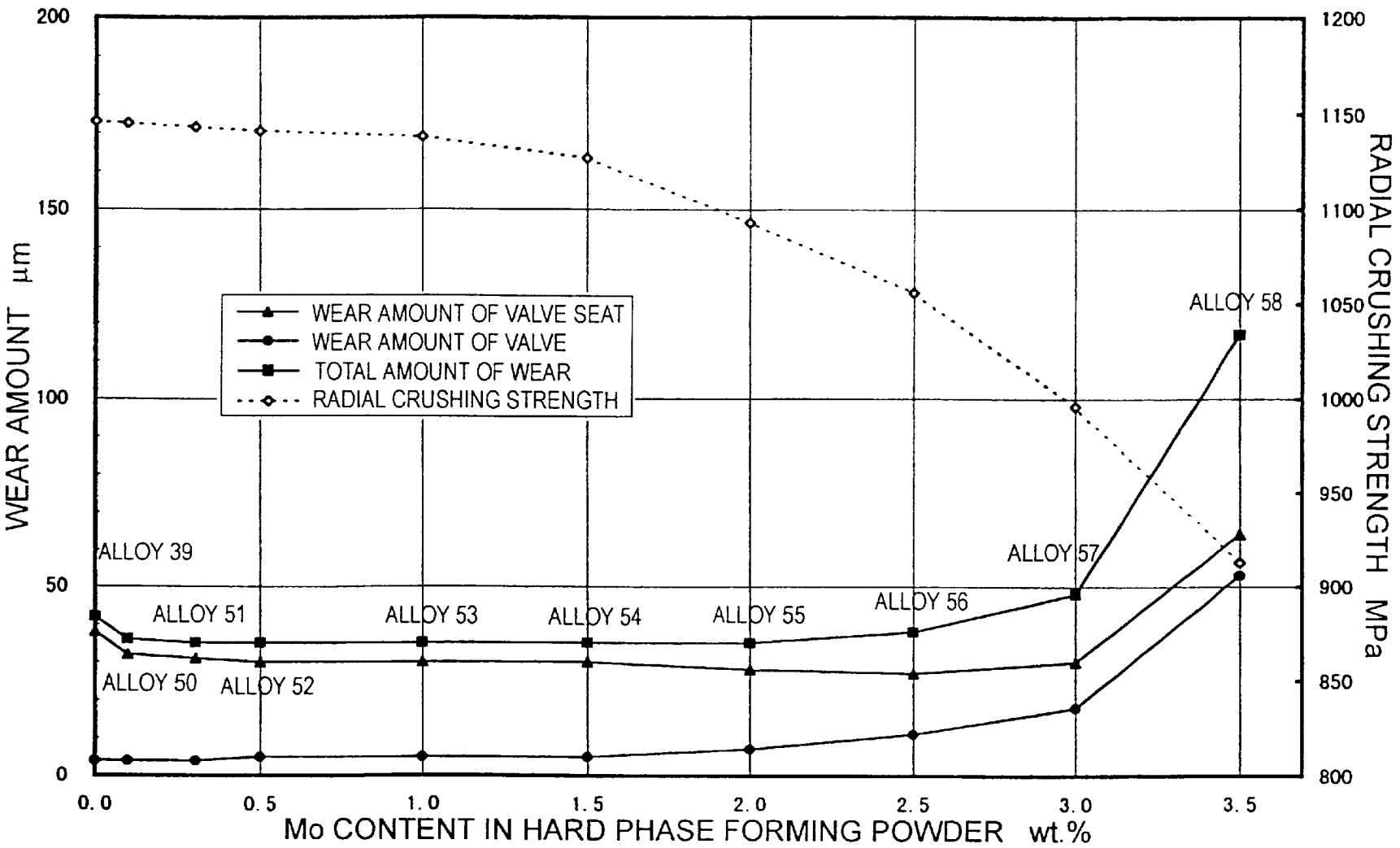
FIG. 9 is a graph showing the relationships between the Mo content in the hard phase forming powder, the wear amount, and the radial crushing strength in embodiments of the present invention.

FIG. 9 is a graph showing comparisons of the relationships between the wear amount and the radial crushing strength of each alloy at differing Mo contents in the hard phase forming powder. As is apparent from FIG. 9, the hardness of the powder increases with the increase in the Mo content in the hard phase forming powder and the compacting property is lowered. The radial crushing strength of the alloy is thereby gradually lowered. It can also be understood from FIG. 9 that when the Mo content is too hight, the wear amount on the valve is worsened by increasing the amount of carbide whereby the wear amount on the valve seat is also promoted. In alloys 51 to 57, in which the Mo content ranges from 0.3 to 3% by weight according to the present invention, the wear amounts on the valve seat and the valve are at extremely low values and are stable, and the radial crushing strength is also maintained in a suitable range. In contrast, in alloy 39 in which the addition amount of the Mo content in the hard phase forming powder is less than 0.3% by weight, since the formation of the carbide is not suitable, the wear amount of the valve seat (VS) is relatively large. In alloy 58, in which the addition amount on the Mo content is more than 3% by weight, the radial crushing strength is lowered by decreasing the compacting property of the powder, and the wear amount on the valve seat increases by decreasing the strength of the matrix and by increasing the wear amount on the valve.

(8) Effect of V Content in Hard Phase Forming Powder

Figure 10:
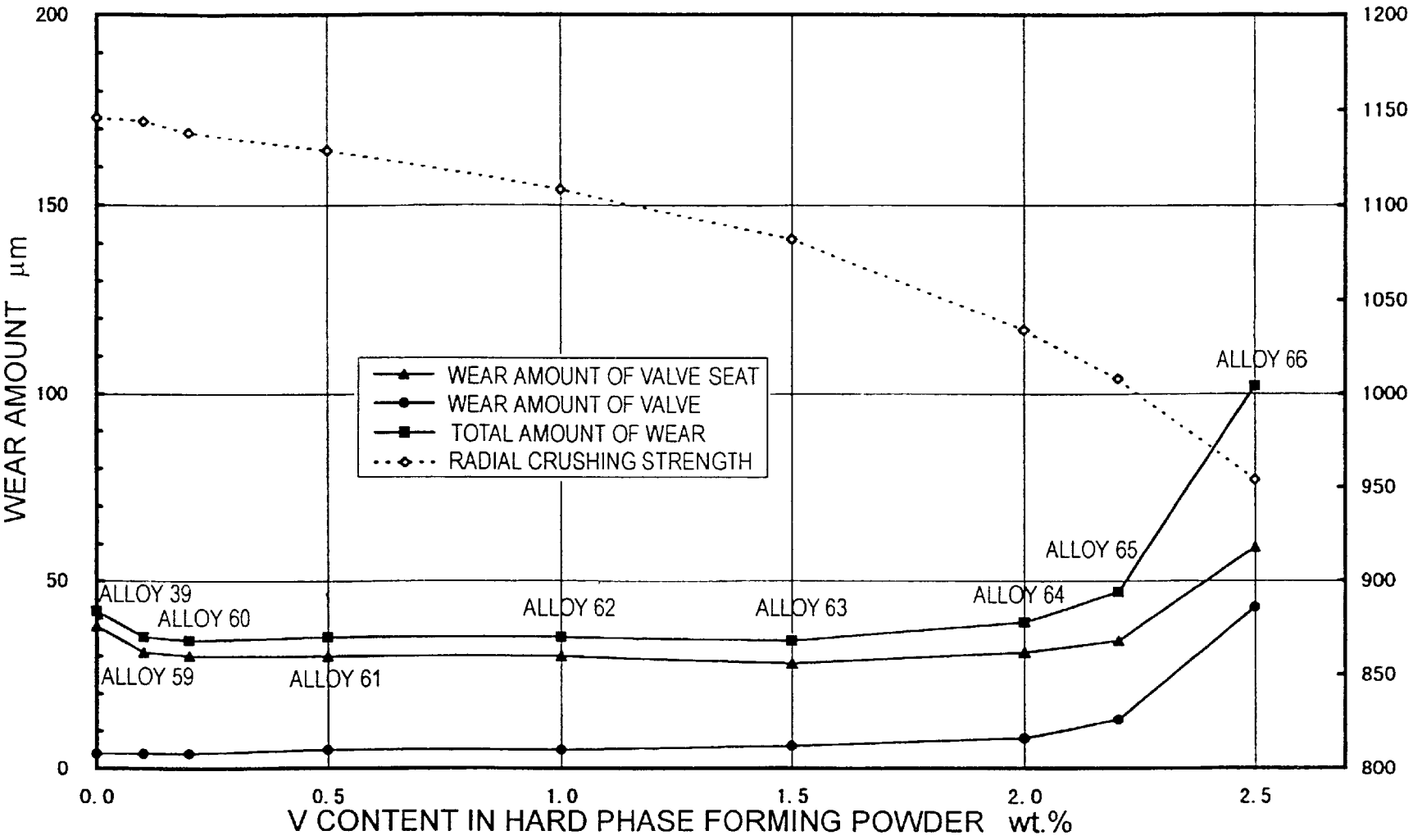
FIG. 10 is a graph showing the relationships between the V content in the hard phase forming powder, the wear amount, and the radial crushing strength in embodiments of the present invention.

FIG. 10 is a graph showing comparisons of the relationships between the wear amount and the radial crushing strength of each alloy at differing V contents in the hard phase forming powder. As is apparent from FIG. 10, the hardness of the powder increases with increase of the V content in the hard phase forming powder, and the compacting property is lowered. The radial crushing strength of the alloy is thereby gradually lowered. It can also be understood from FIG. 10 that when the V content is too high, the wear amount on the valve is worsened by increasing the amount of the carbide whereby the wear amount on the valve seat is also worsened. In alloys 59 to 65 in which the V content ranges from 0.2 to 2.2% by weight according to the present invention, the wear amounts on the valve seat and the valve are at extremely low values and are stable, and the radial crushing strength is also maintained in a suitable range. In contrast, in alloy 39 in which the addition amount of the V content in the hard phase forming powder is less than 0.2% by weight, since the formation of the carbide is not suitable, the wear amount on the valve seat (VS) is relatively large. In alloy 66 in which the addition amount of the Mo content is more than 2.2% by weight, the radial crushing strength is lowered by decreasing the compacting property of the powder, and the wear amount on the valve seat increases by decreasing the strength of the matrix and by increasing the wear amount on the valve.

(9) Effect of W Content in Hard Phase Forming Powder

Figure 11:
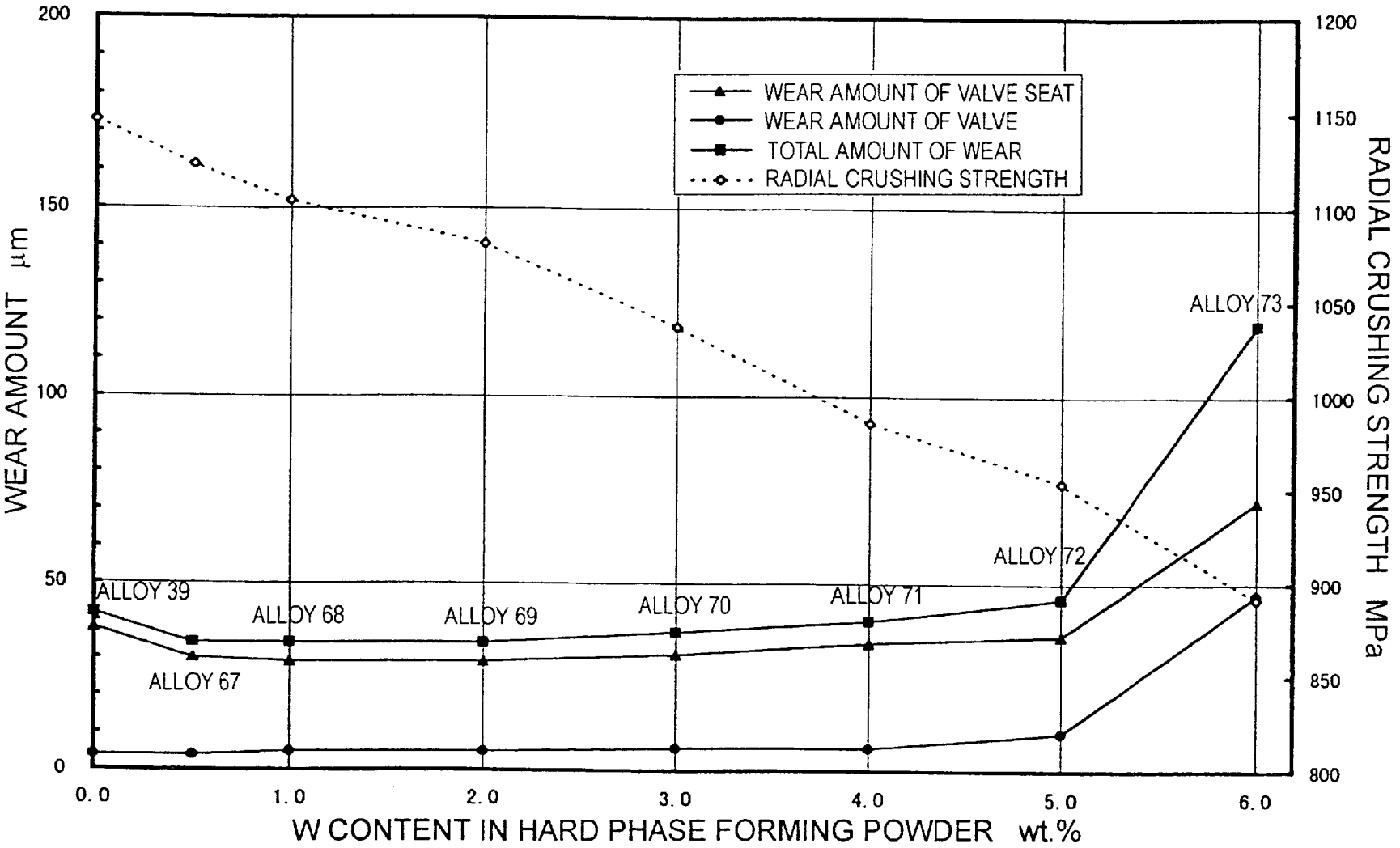
FIG. 11 is a graph showing the relationships between the W content in the hard phase forming powder, the wear amount, and the radial crushing strength in embodiments of the present invention.

FIG. 11 is a graph showing comparisons of the relationships between the wear amount and the radial crushing strength of each alloy at differing W content in the hard phase forming powder. As is apparent from FIG. 11, the hardness of the powder increases with the increase of the W content in the hard phase forming powder and the compacting property is lowered. The radial crushing strength of the alloy is thereby gradually lowered. It can also be understood from FIG. 11 that when the W content is too high, the wear amount on the valve is worsened by increasing the amount of the carbide, whereby the wear amount on the valve seat is also worsened. In alloys 68 to 72 in which the W content ranges from 1 to 5% by weight according to the present invention, the wear amounts on the valve seat and the valve are extremely low values and the radial crushing strength is also maintained in a suitable range. In contrast, in alloy 73 in which the addition amount of the W content in the hard phase forming powder is more than 5% by weight, the radial crushing strength is lowered by decreasing the compacting property of the powder, and the wear amount on the valve seat increases by decreasing the strength of the matrix and by increasing the wear amount on the valve.

(10) Effect of Containing Plural Components such as Mo, etc., in Hard Phase Forming Powder Alloy 76 contains, in percent by weight, Mo in an amount of 3%, V in an amount of 2.2%, and W in an amount of 5%. These values are upper limits of the numerical limitations according to the present invention. Therefore, the effect of containing the plural components with respect to the wear amount and the radial crushing strength, is examined. According to Table 9, the radial crushing strength of the alloy 76 is 947 MPa, the wear amount on the valve seat is 31 $\mu$m, and the wear amount on the valve is 18 $\mu$m. As a result, it was apparent that even if plural components of Mo, V, and W are contained, although the radial crushing strength is slightly lowered, the wear resistant is favorable.

Second Embodiment (1) Producing Samples

As matrix forming powder, simple Ni powder, simple Fe powder, and graphite powder were prepared. As hard phase forming powder, alloy powders shown in Table 3 were prepared. These powders, MnS powder, Pb powder, and $MgSiO_3$ powder as magnesium metasilicate mineral were mixed at the mixing ratios shown in Table 10, and were compacted and sintered at the same conditions as in the first embodiment, whereby alloys 77 to 101 having constituent components shown in Table 11 were produced. Alloys 96 to 101 had infiltrated or impregnated Pb, Cu, or an acrylic resin into the pores thereof. Then, all alloys were subjected the subzero treatment by immersion in liquid nitrogen, and immersion times (in minutes) thereof are shown in Table 10.

TABLE 10

| Sample No. | Matrix Forming Powder: Fe Powder | Matrix Forming Powder: Ni Powder | Matrix Forming Powder: Graphite Powder | Hard Phase Forming Powder | Hard Phase Forming Powder: Powder No. | Machinability Improving Powder: MnS Powder | Machinability Improving Powder: Pb Powder | Machinability Improving Powder: $MgSiO_3$ Powder | Infiltration / Impregnation | Subzero Treatment min |
|---|---|---|---|---|---|---|---|---|---|---|
| Alloy 77 | 63.90 | 10.00 | 1.00 | 25.00 | B39 | 0.10 | | | — | 10.0 |
| Alloy 78 | 63.50 | 10.00 | 1.00 | 25.00 | B39 | 0.50 | | | — | 10.0 |
| Alloy 79 | 63.00 | 10.00 | 1.00 | 25.00 | B39 | 1.00 | | | — | 10.0 |
| Alloy 80 | 62.50 | 10.00 | 1.00 | 25.00 | B39 | 1.50 | | | — | 10.0 |
| Alloy 81 | 62.00 | 10.00 | 1.00 | 25.00 | B39 | 2.00 | | | — | 10.0 |
| Alloy 82 | 61.80 | 10.00 | 1.00 | 25.00 | B39 | 2.20 | | | — | 10.0 |
| Alloy 83 | 63.90 | 10.00 | 1.00 | 25.00 | B39 | | 0.10 | | — | 10.0 |
| Alloy 84 | 63.50 | 10.00 | 1.00 | 25.00 | B39 | | 0.50 | | — | 10.0 |
| Alloy 85 | 63.00 | 10.00 | 1.00 | 25.00 | B39 | | 1.00 | | — | 10.0 |
| Alloy 86 | 62.50 | 10.00 | 1.00 | 25.00 | B39 | | 1.50 | | — | 10.0 |
| Alloy 87 | 62.00 | 10.00 | 1.00 | 25.00 | B39 | | 2.00 | | — | 10.0 |
| Alloy 88 | 61.80 | 10.00 | 1.00 | 25.00 | B39 | | 2.20 | | — | 10.0 |
| Alloy 89 | 63.90 | 10.00 | 1.00 | 25.00 | B39 | | | 0.10 | — | 10.0 |
| Alloy 90 | 63.50 | 10.00 | 1.00 | 25.00 | B39 | | | 0.50 | — | 10.0 |
| Alloy 91 | 63.00 | 10.00 | 1.00 | 25.00 | B39 | | | 1.00 | — | 10.0 |
| Alloy 92 | 62.50 | 10.00 | 1.00 | 25.00 | B39 | | | 1.50 | — | 10.0 |
| Alloy 93 | 62.00 | 10.00 | 1.00 | 25.00 | B39 | | | 2.00 | — | 10.0 |
| Alloy 94 | 61.80 | J0.00 | 1.00 | 25.00 | B39 | | | 2.20 | — | 10.0 |
| Alloy 95 | 62.00 | 10.00 | 1.00 | 25.00 | B39 | 1.00 | 0.50 | 0.50 | — | 10.0 |
| Alloy 96 | 64.00 | 10.00 | 1.00 | 25.00 | B39 | | | | Pb | 10.0 |
| Alloy 97 | 64.00 | 10.00 | 1.00 | 25.00 | B39 | | | | Cu | 10.0 |
| Alloy 98 | 64.00 | 10.00 | 1.00 | 25.00 | B39 | | | | Resin | 10.0 |
| Alloy 77 | 63.50 | 10.00 | 1.00 | 25.00 | B39 | 0.50 | | | — | 10.0 |
| Alloy 99 | 63.50 | 10.00 | 1.00 | 25.00 | B39 | 0.50 | | | Pb | 10.0 |
| Alloy 100 | 63.50 | 10.00 | 1.00 | 25.00 | B39 | 0.50 | | | Cu | 10.0 |
| Alloy 101 | 63.50 | 10.00 | 1.00 | 25.00 | B39 | 0.50 | | | Resin | 10.0 |

TABLE 11

| Sample No. | Overall Constituent Composition Fe Powder | Ni Powder | Cr Powder | Mo Powder | V Powder | C Powder | MnS Powder | Pb Powder | $MgSiO_3$ Powder | γ Amount % | Comments |
|---|---|---|---|---|---|---|---|---|---|---|---|
| Alloy 77 | 84.43 | 10.00 | 3.75 | 0.25 | 0.13 | 1.35 | 0.10 | | | 12.2 | |
| Alloy 78 | 84.03 | 10.00 | 3.75 | 0.25 | 0.13 | 1.35 | 0.50 | | | 12.1 | |
| Alloy 79 | 83.53 | 10.00 | 3.75 | 0.25 | 0.13 | 1.35 | 1.00 | | | 12.1 | |
| Alloy 80 | 83.03 | 10.00 | 3.75 | 0.25 | 0.13 | 1.35 | 1.50 | | | 12.2 | |
| Alloy 81 | 82.53 | 10.00 | 3.75 | 0.25 | 0.13 | 1.35 | 2.00 | | | 12.1 | Within upper limit of Machinability Improving Powder content |
| Alloy 82 | 82.33 | 10.00 | 3.75 | 0.25 | 0.13 | 1.35 | 2.20 | | | 12.0 | Outside upper limit of Machinability Improving Powder Content |
| Alloy 83 | 84.43 | 10.00 | 3.75 | 0.25 | 0.13 | 1.35 | | 0.10 | | 12.1 | Outside lower limit of Machinability Improving Powder content |
| Alloy 84 | 84.03 | 10.00 | 3.75 | 0.25 | 0.13 | 1.35 | | 0.50 | | 12.1 | |
| Alloy 85 | 83.53 | 10.00 | 3.75 | 0.25 | 0.13 | 1.35 | | 1.00 | | 12.1 | |
| Alloy 86 | 83.03 | 10.00 | 3.75 | 0.25 | 0.13 | 1.35 | | 1.50 | | 12.0 | |
| Alloy 87 | 82.53 | 10.00 | 3.75 | 0.25 | 0.13 | 1.35 | | 2.00 | | 12.0 | Within upper limit of Machinability Improving Powder content |
| Alloy 88 | 82.33 | 10.00 | 3.75 | 0.25 | 0.13 | 1.35 | | 2.20 | | 12.0 | Outside upper limit of Machinability Improving Powder content |
| Alloy 89 | 84.43 | 10.00 | 3.75 | 0.25 | 0.13 | 1.35 | | | 0.10 | 12.2 | |
| Alloy 90 | 84.03 | 10.00 | 3.75 | 0.25 | 0.13 | 1.35 | | | 0.50 | 12.2 | |
| Alloy 91 | 83.53 | 10.00 | 3.75 | 0.25 | 0.13 | 1.35 | | | 1.00 | 12.1 | |
| Alloy 92 | 83.03 | 10.00 | 3.75 | 0.25 | 0.13 | 1.35 | | | 1.50 | 12.1 | |
| Alloy 93 | 82.53 | 10.00 | 3.75 | 0.25 | 0.13 | 1.35 | | | 2.00 | 12.0 | Within upper limit of Machinability Improving Powder content |
| Alloy 94 | 82.33 | 10.00 | 3.75 | 0.25 | 0.13 | 1.35 | | | 2.20 | 12.1 | Outside upper limit of Machinability Improving Powder content |
| Alloy 95 | 82.53 | 10.00 | 3.75 | 0.25 | 0.13 | 1.35 | 1.00 | 0.50 | 0.50 | 11.9 | Within upper limit of Machinability Improving Powder content |
| Alloy 96 | 84.53 | 10.00 | 3.75 | 0.25 | 0.13 | 1.35 | | | | 12.2 | Infiltration |
| Alloy 97 | 84.53 | 10.00 | 3.75 | 0.25 | 0.13 | 1.35 | | | | 12.1 | Infiltration |
| Alloy 98 | 84.53 | 10.00 | 3.75 | 0.25 | 0.13 | 1.35 | | | | 12.1 | Acrylic Resin Impregnation |
| Alloy 77 | 84.03 | 10.00 | 3.75 | 0.25 | 0.13 | 1.35 | 0.50 | | | 12.1 | Addition Standard |
| Alloy 99 | 84.03 | 10.00 | 3.75 | 0.25 | 0.13 | 1.35 | 0.50 | | | 12.1 | Addition + Infiltration |
| Alloy 100 | 84.03 | 10.00 | 3.75 | 0.25 | 0.13 | 1.35 | 0.50 | | | 12.2 | Addition + Infiltration |
| Alloy 101 | 84.03 | 10.00 | 3.75 | 0.25 | 0.13 | 1.35 | 0.50 | | | 12.0 | Acrylic Resin Impregnation |

(2) Evaluation of Mechanical Strength and Machinability

The above alloys were subjected to measurements of radial crushing strength, simple wear tests, and machinability tests. The results are shown in Table 12 and in FIGS. 12 through 15. The machinability test is a test in which a sample is drilled with a prescribed load using a bench drill and the number of the successful machining processes are compared. In the present test, the load was set to 1.0 kg, and the drill used was a ϕ3 cemented carbide drill. The thickness of the sample was set to 3 mm.

TABLE 12

| Sample No. | γ Amount % | Evaluated Item: Radial Crushing Strength MPa | Wear Amount μm: Valve Seat | Valve | Total | Number of Machined Pores | Comments |
|---|---|---|---|---|---|---|---|
| Alloy 77 | 12.2 | 1108 | 29 | 6 | 35 | 29 | |
| Alloy 78 | 12.1 | 1074 | 32 | 6 | 38 | 31 | |
| Alloy 79 | 12.1 | 1022 | 36 | 5 | 41 | 34 | |
| Alloy 80 | 12.2 | 985 | 40 | 5 | 45 | 36 | |
| Alloy 81 | 12.1 | 912 | 44 | 14 | 58 | 38 | Within upper limit of Machinability Improving Powder content |
| Alloy 82 | 12.0 | 824 | 88 | 21 | 109 | 39 | Outside upper limit of Machinability Improving Powder content |
| Alloy 83 | 12.1 | 1114 | 26 | 4 | 30 | 30 | Outside lower limit of Machinability Improving Powder content |
| Alloy 84 | 12.1 | 1082 | 23 | 4 | 27 | 33 | |
| Alloy 85 | 12.1 | 1036 | 21 | 3 | 24 | 36 | |
| Alloy 86 | 12.0 | 992 | 28 | 3 | 31 | 39 | |
| Alloy 87 | 12.0 | 916 | 32 | 10 | 42 | 41 | Within upper limit of Machinability Improving Powder content |
| Alloy 88 | 12.0 | 831 | 66 | 26 | 92 | 42 | Outside upper limit of Machinability Improving Powder content |

TABLE 12-continued

| Sample No. | γ Amount % | Evaluated Item: Radial Crushing Strength MPa | Wear Amount μm: Valve Seat | Valve | Total | Number of Machined Pores | Comments |
|---|---|---|---|---|---|---|---|
| Alloy 89 | 12.2 | 1113 | 28 | 6 | 34 | 27 | |
| Alloy 90 | 12.2 | 1075 | 30 | 6 | 36 | 30 | |
| Alloy 91 | 12.1 | 1028 | 33 | 5 | 38 | 32 | |
| Alloy 92 | 12.1 | 990 | 37 | 5 | 42 | 34 | |
| Alloy 93 | 12.0 | 934 | 42 | 13 | 55 | 35 | Within upper limit of Machinability Improving Powder content |
| Alloy 94 | 12.1 | 807 | 81 | 26 | 107 | 36 | Outside upper limit of Machinability Improving Powder content |
| Alloy 95 | 11.9 | 910 | 45 | 13 | 58 | 46 | Within upper limit of Machinability Improving Powder content |
| Alloy 96 | 12.2 | 1149 | 24 | 3 | 27 | 35 | Infiltration |
| Alloy 97 | 12.1 | 1178 | 24 | 8 | 32 | 43 | Infiltration |
| Alloy 98 | 12.1 | 1120 | 28 | 6 | 34 | 39 | Acrylic Resin Impregnation |
| Alloy 77 | 12.1 | 1074 | 32 | 6 | 38 | 31 | Addition Standard |
| Alloy 99 | 12.1 | 1031 | 28 | 4 | 32 | 42 | Addition + Infiltration |
| Alloy 100 | 12.2 | 1063 | 29 | 8 | 37 | 50 | Addition + Infiltration |
| Alloy 101 | 12.0 | 1021 | 32 | 6 | 38 | 48 | Acrylic Resin Impregnation |

(3) Effect of Adding MnS Powder

Figure 12:
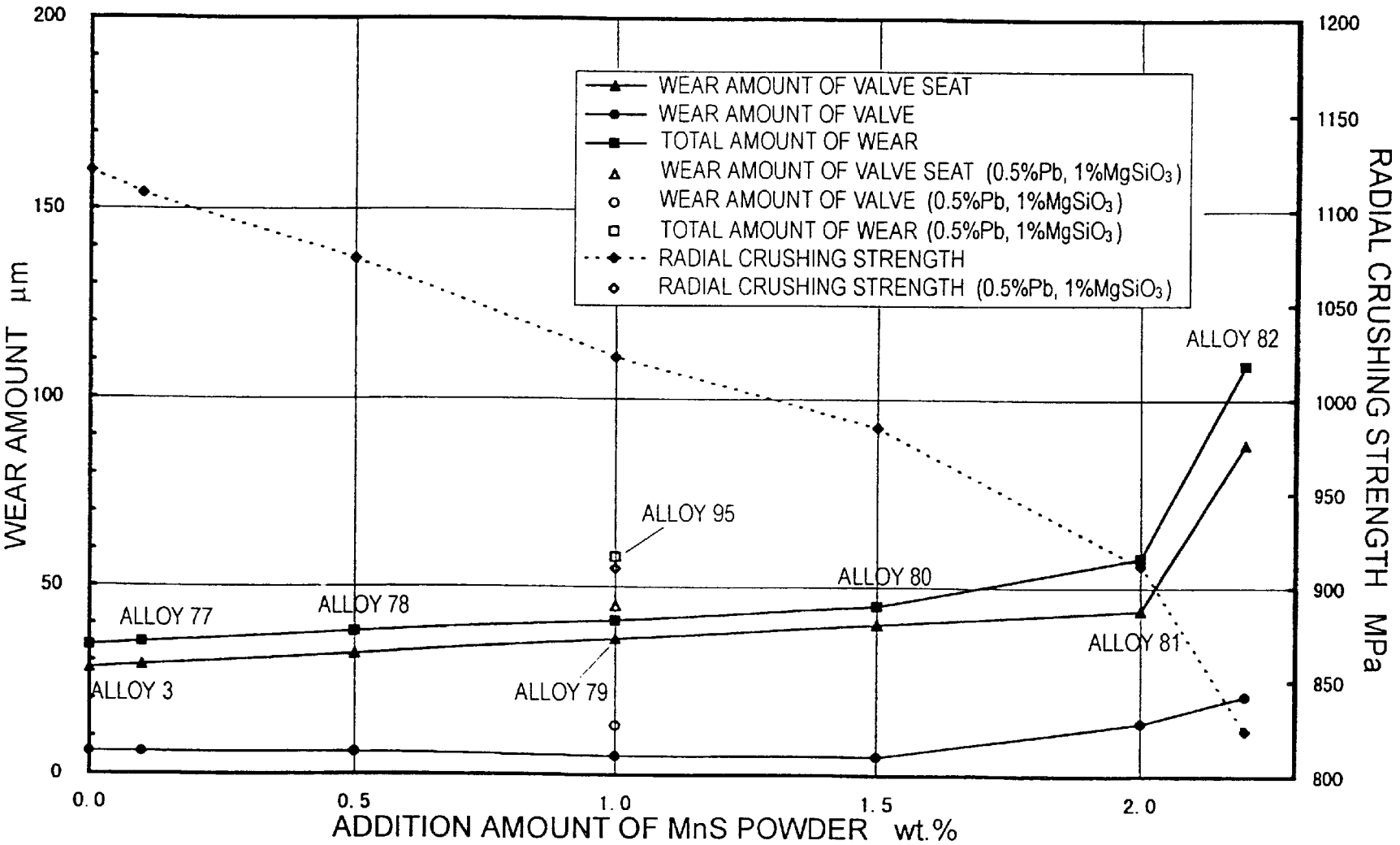
FIG. 12 is a graph showing the relationships between the addition amount of MnS powder, the wear amount, and the radial crushing strength in embodiments of the present invention.
Figure 13:
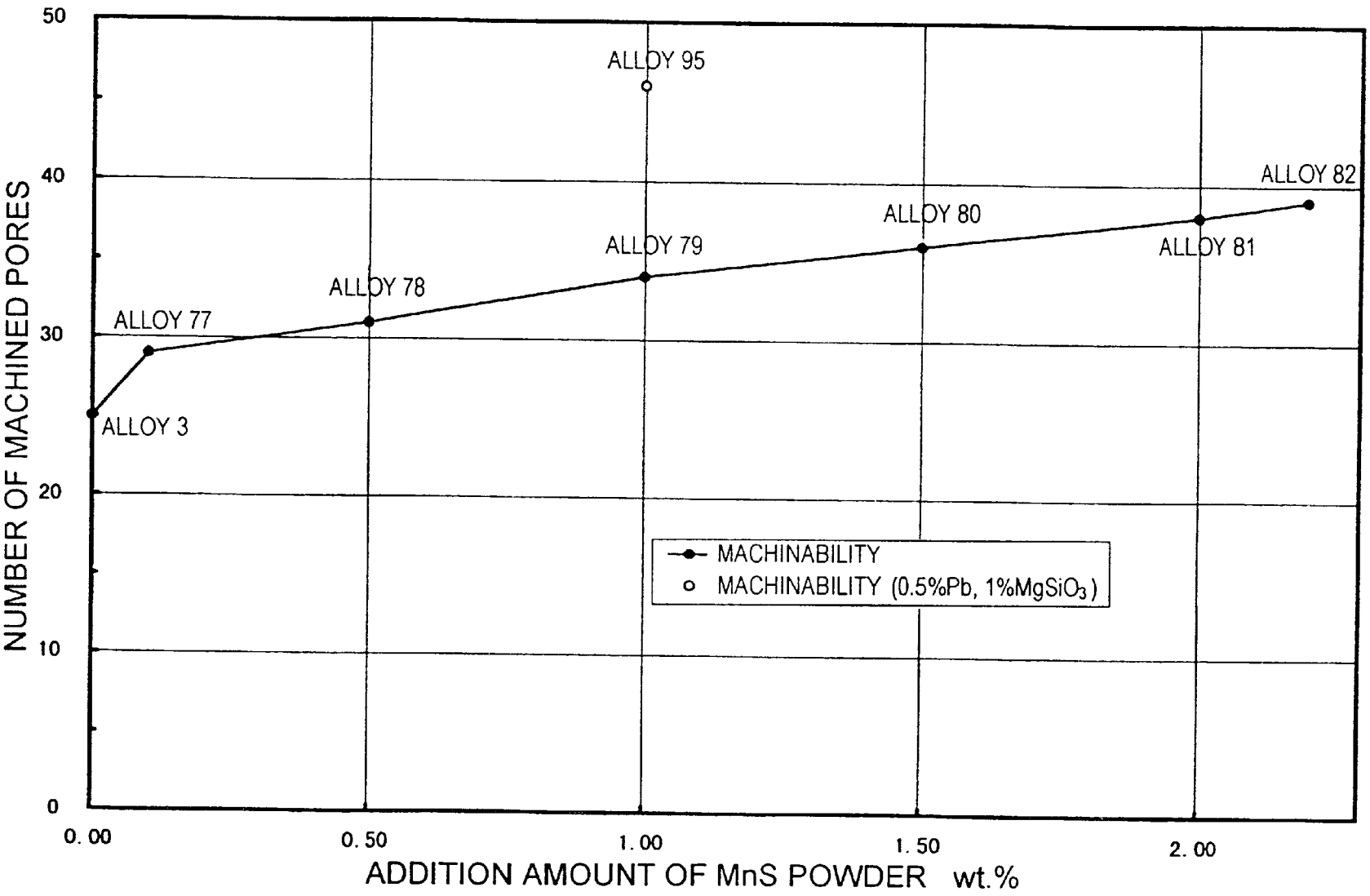
FIG. 13 is a graph showing the relationships between the addition amount of MnS powder and the number of machined pores in embodiments of the present invention.

FIG. 12 is a graph showing comparisons of the relationships between the wear amount and the radial crushing strength of each alloy at differing addition amounts of the MnS powder as a machinability improving component. FIG. 13 is a graph showing comparisons of the number of machined pores. As is apparent from FIG. 13, with increase in addition amount of the MnS powder, machinability is improved by effects of the MnS particles dispersed in the matrix. However, as shown in FIG. 12, the MnS powder interferes with dispersion of the powders during sintering, whereby it was apparent that the strength of the matrix is lowered, and the radial crushing strength is lowered. As is apparent from FIG. 12, when the addition amount of the MnS powder is less than 2.0% by weight, the wear amount on the valve seat increases slightly; however the amount is low, whereby superior wear resistance is obtained. In contrast, when the addition amount is more than 2.0% by weight, the wear amount on the valve seat increases by lowering the matrix strength. Therefore, it was apparent that machinability can be improved by adding the MnS powder in an amount of 2.0% or less, without deteriorating the mechanical strength and the wear resistance.

(4) Effect of Adding Pb Powder

Figure 14:
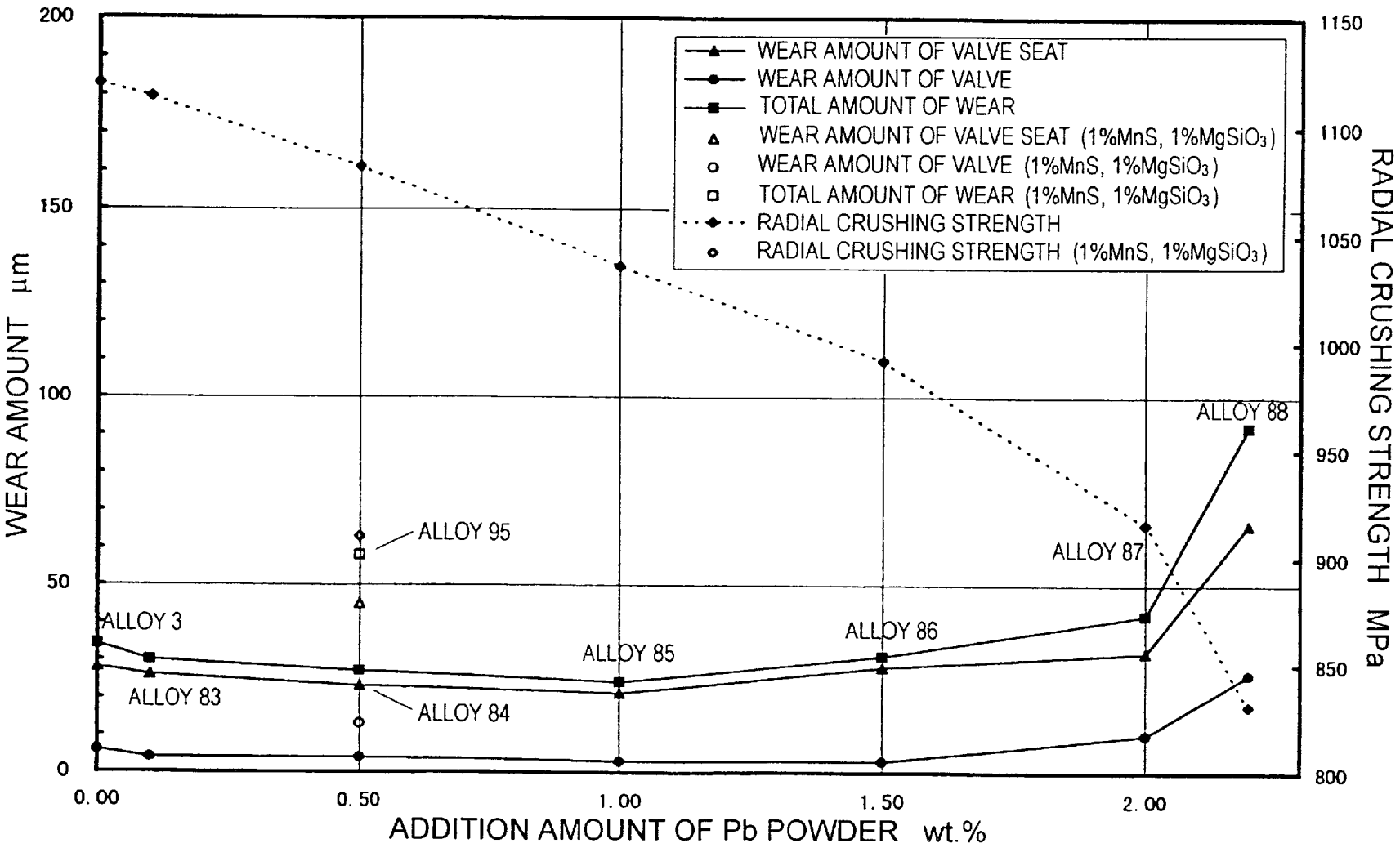
FIG. 14 is a graph showing the relationships between the addition amount of Pb powder, the wear amount, and the radial crushing strength in embodiments of the present invention.
Figure 15:
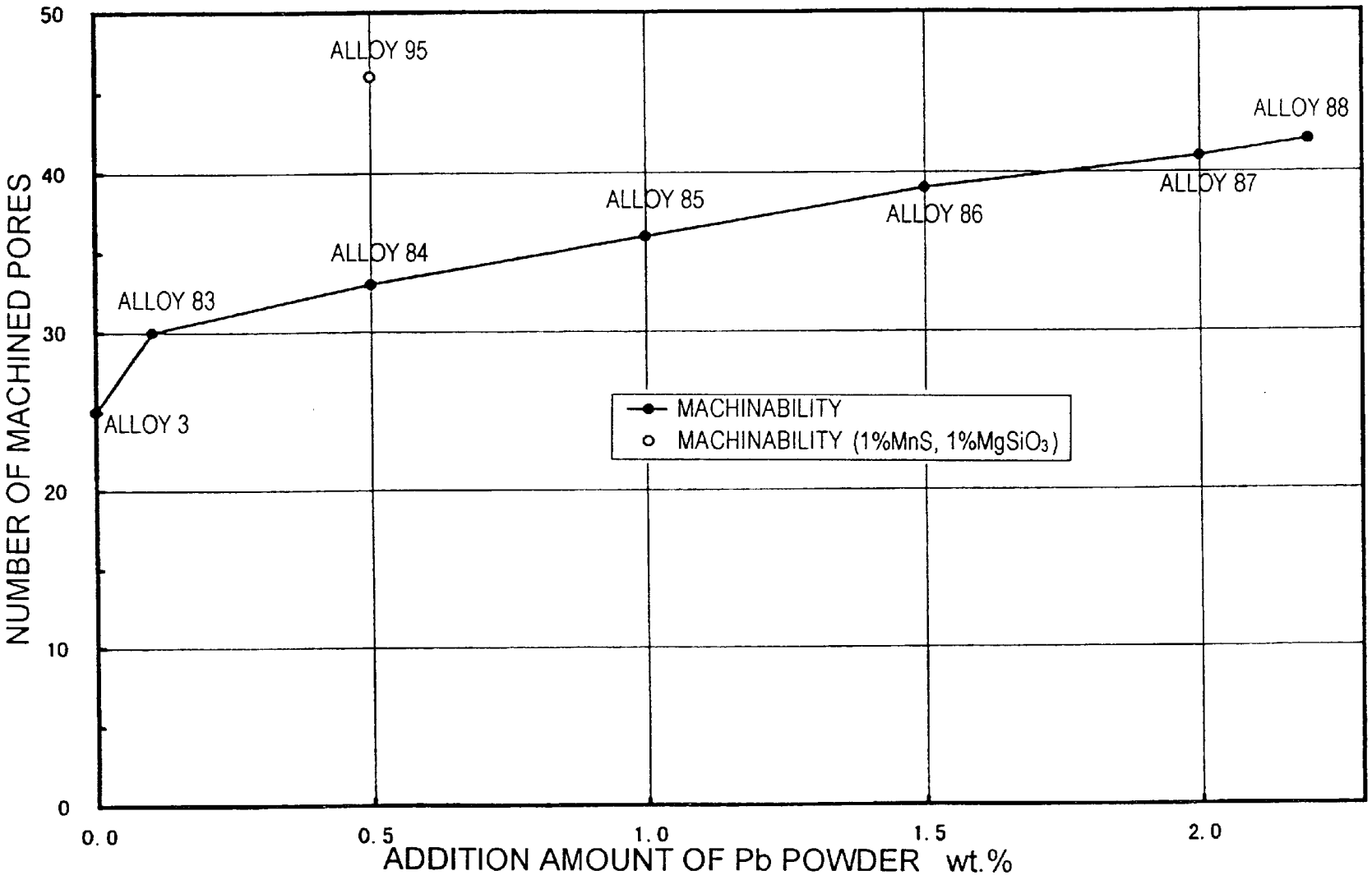
FIG. 15 is a graph showing the relationships between the addition amount of Pb powder and the number of machined pores in embodiments of the present invention.

FIG. 14 is a graph showing comparisons of the relationships between the wear amount and the radial crushing strength of each alloy at differing addition amounts of the Pb powder as a machinability improving component. FIG. 15 is a graph showing comparisons of the number of machined pores. It is apparent from FIG. 15 that machinability is improved by an increase in the addition amount of the Pb powder. As is apparent from FIG. 14, when the addition amount of the Pb powder is less than 2.0% by weight, a metallographic structure dispersed fine Pb phase in the matrix is formed, whereby with respect to the mechanical strength and the wear resistance, superior properties similar to those in non-addition cases are obtained. In contrast, when the addition amount is more than 2.0% by weight, the wear resistance is lowered. The reason for this is believed to be as follows. That is to say, by adding the Pb powder in an amount of 2.0% by weight or more, the Pb powders adhere and a coarsened Pb phase is formed in the matrix. This coarsened Pb phase in the matrix causes an expansion phenomenon of Pb at high temperatures, whereby force, which expands the matrix, increases, so that the strength of the matrix is lowered. However, this tendency remarkably does not appear in the radial test at room temperature. Therefore, it was apparent that the machinability can be improved by adding the Pb powder in an amount of 2.0% or less, without deteriorating the mechanical strength and the wear resistance.

(5) Effect of Adding Magnesium Metasilicate Mineral Powder

Figure 16:
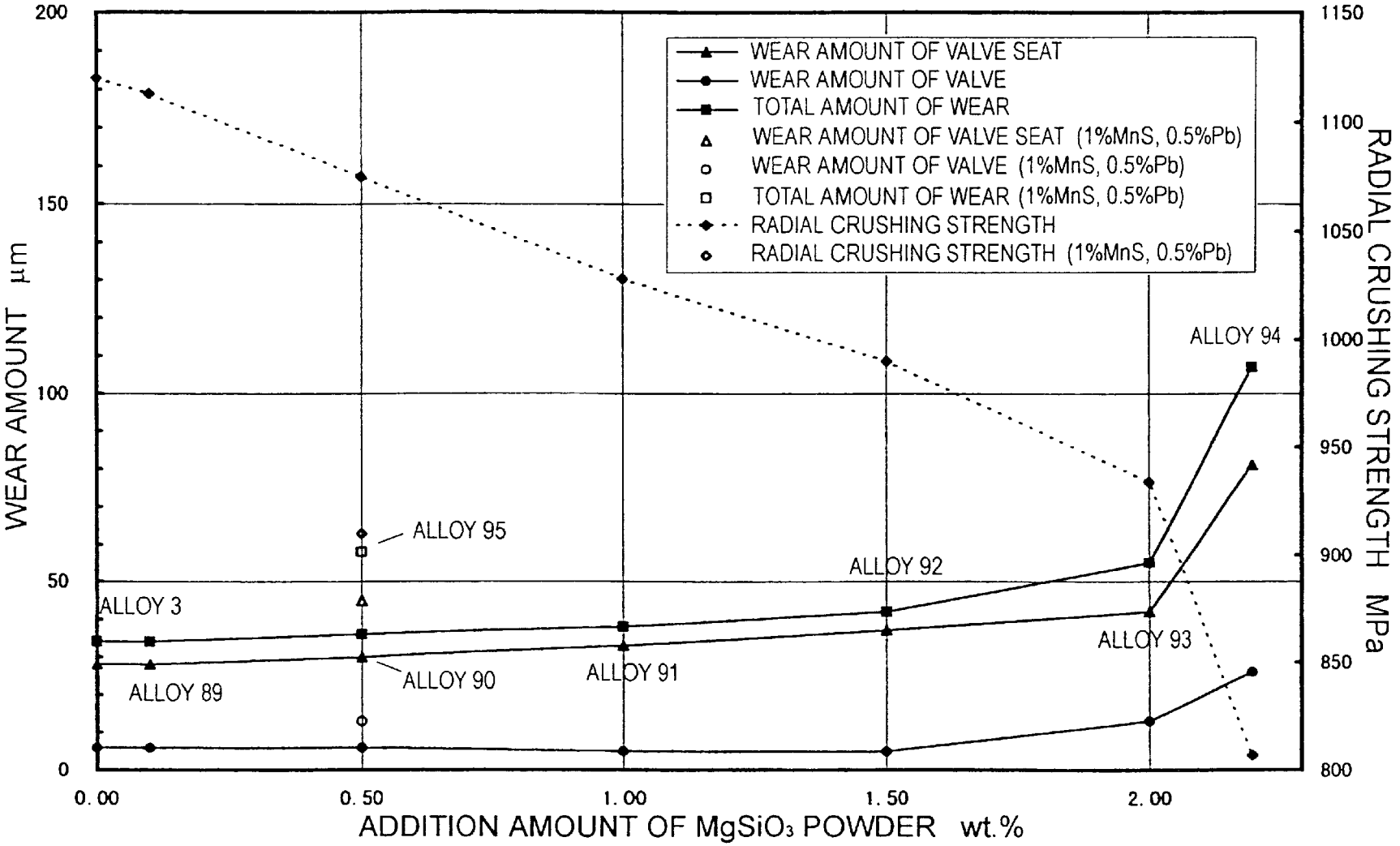
FIG. 16 is a graph showing the relationships between the addition amount of $MgSiO_3$ powder, the wear amount, and the radial crushing strength in embodiments of the present invention.
Figure 17:
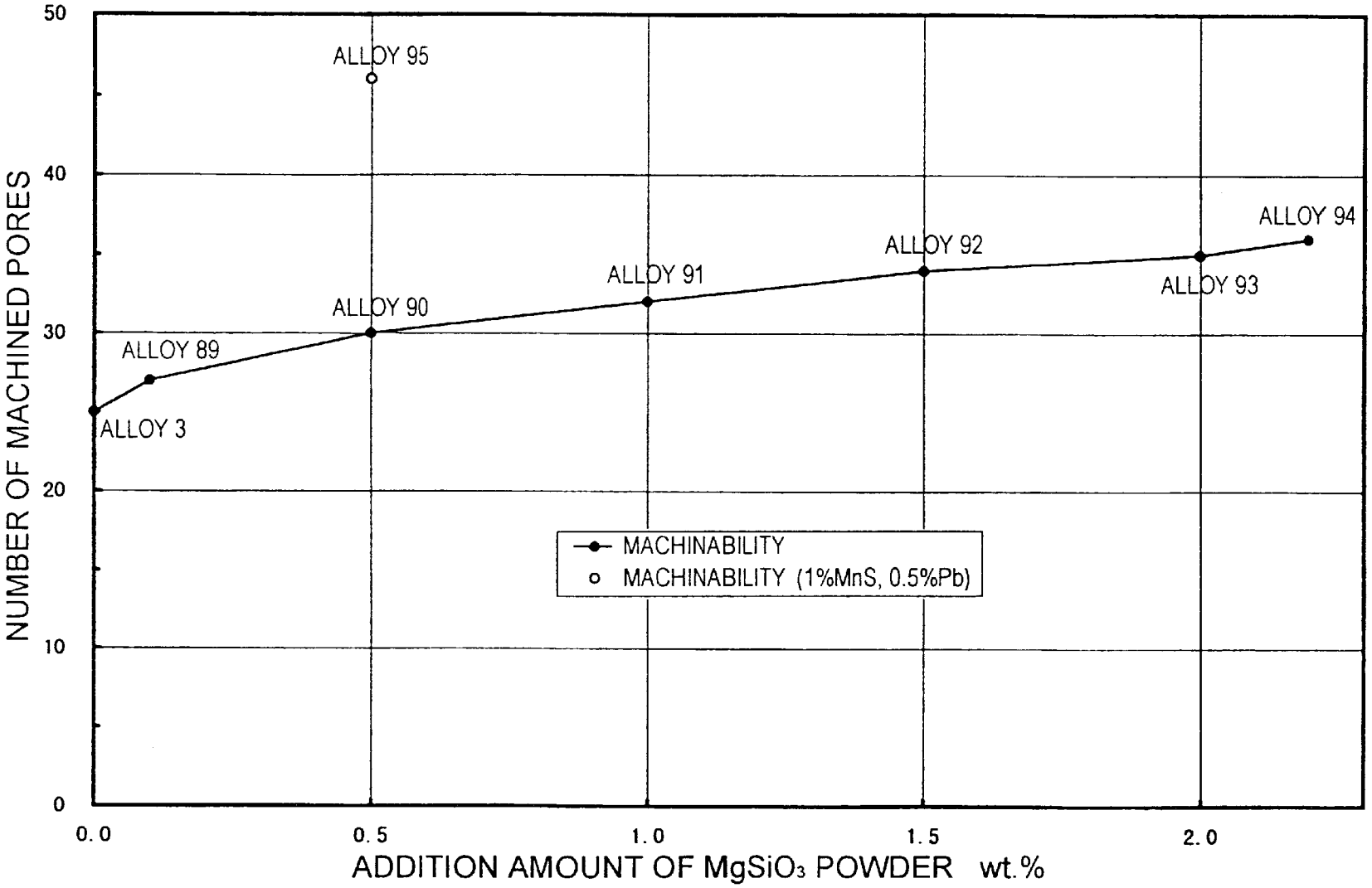
FIG. 17 is a graph showing the relationships between the addition amount of $MgSiO_3$ powder and the number of machined pores in embodiments of the present invention.

FIG. 16 is a graph showing comparisons of the relationships between the wear amount and the radial crushing strength of each alloy at differing addition amounts of the $MgSiO_3$ powder as a machinability improving component. FIG. 17 is a graph showing comparisons of the number of machined pores. It is apparent from FIG. 17 that with the increase of the addition amount of the $MgSiO_3$ powder, the machinability is improved by effects of $MgSiO_3$ particles dispersed in the matrix. As is apparent from FIG. 16, it was clear that with the increase of the addition amount of the $MgSiO_3$ powder, the $MgSiO_3$ powder interferes with dispersion of the powders during sintering, whereby the strength of the matrix is lowered, so that the radial crushing strength is lowered. As is apparent from FIG. 16, when the addition amount of the $MgSiO_3$ powder is less than 2.0% by weight, the wear amount on the valve seat increases slightly; however the amount is low, whereby the superior wear resistance is obtained. In contrast, when the addition amount is more than 2.0% by weight, the wear amount on the valve seat increases by lowering the matrix strength. Therefore, it was apparent that machinability can be improved by adding $MgSiO_3$ powder in an amount of 2.0% or less, without deteriorating the mechanical strength and the wear resistance.

(6) Effect of Infiltration by Pb etc.

Figure 18:
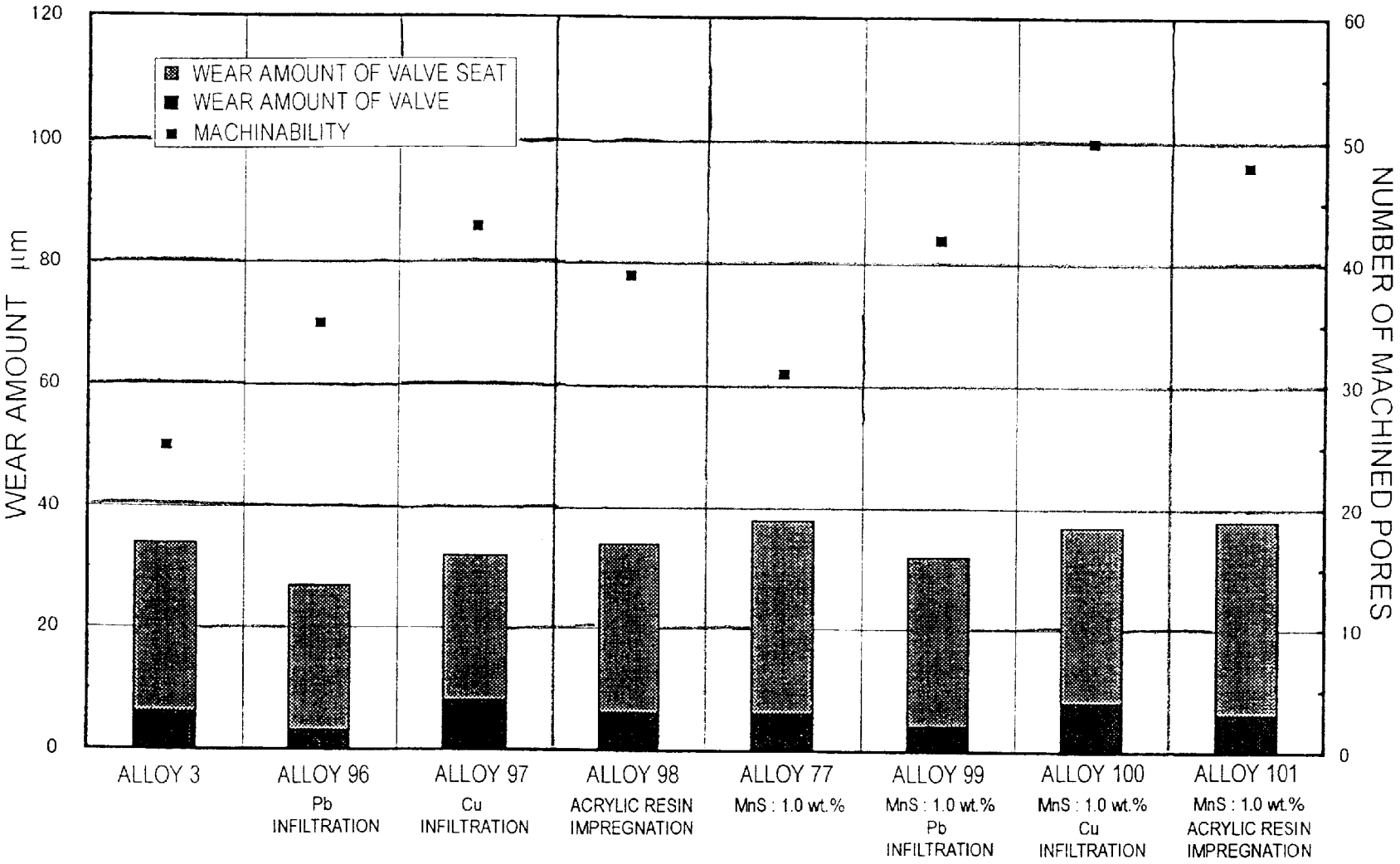
FIG. 18 is a graph showing how the infiltration or impregnation of lead, copper, and an acrylic resin affects the wear amount, and the number of machined pores in embodiments of the present invention.

FIG. 18 is a graph showing comparisons of the relationships between the wear amount and the number of machined pores in alloys in which Pb, etc., is infiltrated or impregnated. The wear amount and the number of machined pores in alloy 3, which was not subjected to the infiltration, etc., are shown for comparison. As is apparent from FIG. 18, even if Pb, Cu, or acrylic resin is infiltrated or impregnated into the pores, the wear resistance is equal to that in the case in which the infiltration or the impregnation is not carried out, or is greater, and machinability can be drastically improved while maintaining superior wear resistance.

It should be noted that the sintered alloys having superior wear resistance according to the present invention is not limited to the valve seats as in the above embodiment, but can be similarly applied to various parts which are required to have superior wear resistance.

As described above, in a sintered alloy having superior wear resistance and in a process of manufacture therefor, there can be provided a higher wear resistance than by conventional techniques for sintered alloys for valve seats of internal combustion engines. Furthermore, by applying manganese sulfide powder, lead powder, boron nitride powder, or magnesium metasilicate mineral powder, or by infiltrating or impregnating lead, copper, a copper alloy, or an acrylic resin, machinability can be improved while maintaining favorable wear resistance.

What is claimed is:

1. A sintered alloy having superior wear resistance, having an overall composition consisting of, in percent by weight, Ni in an amount of 6.0 to 25.0%, Cr in an amount of 0.6 to 8.75%, C in an amount of 0.54 to 2.24%, and balance consisting of Fe and inevitable impurity, said sintered alloy exhibiting a metallographic structure in which the following hard phase is dispersed in a mixed structure of martensite and austenite:

said hard phase comprising, a core consisting of Cr carbide; and a ferrite phase diffused Cr, or a mixed phase of ferrite and austenite diffused Cr, surrounding said core, and an area ratio of austenite in said mixed structure in said metallographic structure ranging from 5 to 30%.

2. A sintered alloy having superior wear resistance, having an overall composition consisting of, in percent by weight, Ni in an amount of 6.0 to 25.0%, Cr in an amount of 0.6 to 8.75%, C in an amount of 0.54 to 2.24%, at least one of Mo in an amount of 0.05 to 1.05%; V in an amount of 0.03 to 0.77%; and W in an amount of 0.15 to 1.75%, and balance consisting of Fe and inevitable impurity, said sintered alloy exhibiting a metallographic structure in which the following hard phase is dispersed in a mixed structure of martensite and austenite:

said hard phase comprising, a core consisting of Cr carbide as a main component; and a ferrite phase diffused Cr, or a mixed phase of ferrite and austenite diffused Cr, surrounding said core, and an area ratio of austenite in said mixed structure in said metallographic structure ranging from 5 to 30%.

3. A sintered alloy having superior wear resistance, having an overall composition consisting of, in percent by weight, Ni in an amount of 6.0 to 25.0%, Cr in an amount of 0.6 to 8.75%, C in an amount of 0.54 to 2.24%, and balance consisting of Fe and inevitable impurity, said sintered alloy exhibiting a metallographic structure in which the following hard phase is dispersed in a mixed structure of martensite, austenite, and at least one of bainite and sorbite:

said hard phase comprising, a core consisting of Cr carbide; and a ferrite phase diffused Cr, or a mixed phase of ferrite and austenite diffused Cr, surrounding said core, and an area ratio of austenite in said mixed structure in said metallographic structure ranging from 5 to 30%.

4. A sintered alloy having superior wear resistance, having an overall composition consisting of, in percent by weight, Ni in an amount of 6.0 to 25.0%, Cr in an amount of 0.6 to 8.75%, C in an amount of 0.54 to 2.24%, at least one of Mo in an amount of 0.05 to 1.05%; V in an amount of 0.03 to 0.77%; and W in an amount of 0.15 to 1.75%, and balance consisting of Fe and inevitable impurity, said sintered alloy exhibiting a metallographic structure in which the following hard phase is dispersed in a mixed structure of martensite, austenite, and at least one of bainite and sorbite:

said hard phase comprising, a core consisting of Cr carbide as a main component; and a ferrite phase diffused Cr, or a mixed phase of ferrite and austenite diffused Cr, surrounding said core, and an area ratio of austenite in said mixed structure in said metallographic structure ranging from 5 to 30%.

5. A sintered alloy having superior wear resistance as recited in claim 1 wherein said metallographic structure includes at least one compound, dispersed therein, present in an amount of 0.1 to 2.0% by weight, said compound selected from the group consisting of lead, manganese sulfide, boron nitride and magnesium metasilicate mineral.

6. A sintered alloy having superior wear resistance as recited in claim 2 wherein said metallographic structure includes at least one compound, dispersed therein, present in an amount of 0.1 to 2.0% by weight, said compound selected from the group consisting of lead, manganese sulfide, boron nitride and magnesium metasilicate mineral.

7. A sintered alloy having superior wear resistance as recited in claim 3 wherein said metallographic structure includes at least one compound, dispersed therein, present in an amount of 0.1 to 2.0% by weight, said compound selected from the group consisting of lead, manganese sulfide, boron nitride and magnesium metasilicate mineral.

8. A sintered alloy having superior wear resistance as recited in claim 4 wherein said metallographic structure includes at least one compound, dispersed therein, present in an amount of 0.1 to 2.0% by weight, said compound selected from the group consisting of lead, manganese sulfide, boron nitride and magnesium metasilicate mineral.

9. A sintered alloy having superior wear resistance as recited in claim 1 wherein pores are formed in said sintered alloy, said pores filled with lead, copper, a copper alloy or an acrylic resin.

10. A sintered alloy having superior wear resistance as recited in claim 2 wherein pores are formed in said sintered alloy, said pores filled with lead, copper, a copper alloy or an acrylic resin.

11. A sintered alloy having superior wear resistance as recited in claim 3 wherein pores are formed in said sintered alloy, said pores filled with lead, copper, a copper alloy or an acrylic resin.

12. A sintered alloy having superior wear resistance as recited in claim 4 wherein pores are formed in said sintered alloy, said pores filled with lead, copper, a copper alloy or an acrylic resin.

13. A sintered alloy having superior wear resistance as recited in claim 5, wherein pores formed in said sintered alloy filled with lead, copper, a copper alloy, or an acrylic resin.

14. A sintered alloy having superior wear resistance as recited in claim 6, wherein pores formed in said sintered alloy filled with lead, copper, a copper alloy, or an acrylic resin.

15. A sintered alloy having superior wear resistance as recited in claim 7, wherein pores formed in said sintered alloy filled with lead, copper, a copper alloy, or an acrylic resin.

16. A sintered alloy having superior wear resistance as recited in claim 8, wherein pores formed in said sintered alloy filled with lead, copper, a copper alloy, or an acrylic resin.

* * * * *